US007171748B2

(12) United States Patent
Kigami et al.

(10) Patent No.: US 7,171,748 B2
(45) Date of Patent: Feb. 6, 2007

(54) METHOD OF MANUFACTURING A LIQUID JET RECORDING HEAD

(75) Inventors: Hiroyuki Kigami, Kanagawa (JP); Manabu Tanimoto, Kanagawa (JP); Noaki Nakajo, Kanagawa (JP); Junichiro Iri, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 306 days.

(21) Appl. No.: 10/651,734

(22) Filed: Aug. 29, 2003

(65) Prior Publication Data

US 2004/0040152 A1 Mar. 4, 2004

(30) Foreign Application Priority Data

Aug. 30, 2002 (JP) ..... 2002-254892

(51) Int. Cl.
*B21D 53/76* (2006.01)
*B41J 2/14* (2006.01)

(52) U.S. Cl. ..... 29/890.1; 29/831; 29/841; 29/855; 347/50

(58) Field of Classification Search ..... 29/890.1, 29/831, 841, 855; 264/255, 279.1; 427/504, 427/552, 663, 487, 97.5, 97.6; 347/50, 58
See application file for complete search history.

(56) References Cited

U.S. PATENT DOCUMENTS

| | | | | |
|---|---|---|---|---|
| 5,157,418 A * | 10/1992 | Tamura | ..... | 347/58 |
| 5,227,812 A * | 7/1993 | Watanabe et al. | ..... | 347/50 |
| 5,420,620 A * | 5/1995 | Tamura | ..... | 347/50 |
| 5,557,843 A * | 9/1996 | McKenney et al. | ..... | 29/851 |
| 6,609,782 B2 * | 8/2003 | Mori | ..... | 347/50 |

* cited by examiner

*Primary Examiner*—A. Dexter Tugbang
*Assistant Examiner*—Tai Van Nguyen
(74) *Attorney, Agent, or Firm*—Morgan & Finnegan, LLP

(57) ABSTRACT

Disclosed is a manufacturing method of a liquid jet recording head which includes a forming step of forming a recess portion between a flexible film wiring board and a recording element board, a providing step of providing in the recess portion an electrical connecting portion for electrically connecting the flexible film wiring board and the recording element board, a membrane curing step of injecting first resin into the recess portion to cure the first resin in a membrane form, and a covering step of covering an upper portion of the electrical connecting portion and the first resin with second resin subsequent to the membrane curing step. The electrical connecting portion is protected against liquid droplets and the like, and its electrical reliability is improved.

6 Claims, 21 Drawing Sheets

METHOD OF MANUFACTURING A LIQUID JET RECORDING HEAD

BACKGROUND OF THE INVENTION

1. Field of the Invention

The present invention relates to a manufacturing method of a liquid jet recording head for performing recording on a recording medium by discharging recording liquid from its minute discharge port as liquid droplets.

2. Related Background Art

A typical example of a liquid jet recording apparatus of a so-called non-impact recording type is comprised of a liquid jet recording head for executing recording on a recording medium, and a recording liquid supply system for supplying the recording liquid to the recording head. In the liquid jet recording head, an electrothermal converting element is used as an element for generating discharge energy, and droplets of the recording liquid are discharged from its minute discharge port by the discharge energy.

Further, as a liquid jet recording head using an electrothermal converting system, there have been proposed a system wherein droplets are discharged in a direction parallel to a board plane on which plural electrothermal converting elements are arranged, and a system wherein droplets are discharged in a direction perpendicular to a board plane on which plural electrothermal converting elements are arranged.

FIGS. 29A to 29C illustrate a board (also referred to as a recording element board) on which a plurality of general electrothermal converting elements are arranged, and which functions to discharge liquid droplets. FIGS. 29A, 29B and 29C are its plan view, its bottom view, and its side view, respectively. FIG. 30 is a view illustrating a state in which the recording element board of FIGS. 29A to 29C is connected to a wiring board.

As illustrated in FIGS. 29A to 29C, a recording element board 101 is equipped with a through hole (a recording liquid supply port) 103 for supplying recording liquid from its bottom side. A plurality of electrothermal converting elements (not shown) for imparting discharge energy to the recording liquid are arranged on both sides of the through holes 103 on the surface of a board 102, respectively. Further, a discharge plate 105 is placed on the board 102, and plural discharge ports 106 facing the respective electrothermal converting elements are formed in the discharge plate 105. Plural electrodes 107 are further provided on both end portions of the surface of the board 102, and the electrodes 107 are electrically connected to the electrothermal converting elements, respectively.

Further, as illustrated in FIG. 30, plural electrodes 107 formed on the recording element board 101 are electrically connected to plural respective leads 113 formed on a flexible film wiring board 111 by TAB techniques, for example. A recording element unit 120 is thus constructed. The entire electrical connecting portion is protectively covered with sealing resin 119 so as to be protected from corrosion by the recording liquid and wiring breakage by external force.

FIGS. 31A and 31B exemplify a conventional liquid jet recording head equipped with the recording element unit as illustrated in FIG. 30. FIG. 31A is its perspective view, and FIG. 31B is a cross-sectional enlarged view taken along the line A—A in FIG. 31A.

As illustrated in FIG. 31B, the recording element unit is bonded to the upper surface of a support member 108 with adhesive resin 121. Further, a support plate 109 is bonded to the upper surface of the support member 108 by adhesive resin 122, and the flexible film wiring board 111 is bonded to the upper surface of the support plate 109 by adhesive resin 123. Furthermore, fixed to the side surface of the support member 109 is a second wiring board 116 which is provided with external input pads 115 for supplying electrical signals, such as recording information, to the liquid jet recording head from the side of a body of the recording apparatus. The second wiring board 116 is electrically connected to each recording element unit through the flexible film wiring board 111*a*, 111*b*, 111*c*, or 111*d*.

As illustrated in FIG. 31B, a recess portion 117 formed between the support plate 109 and the recording element board 101 is protectively covered with first sealing resin 118 so as to prevent corrosion by the recording liquid and short circuit through the recording liquid.

FIG. 32 is a cross-sectional view illustrating another conventional liquid jet recording head.

As illustrated FIG. 32, the through port (a recording liquid supply port) 103 is formed in the board 102 to supply the recording liquid from its bottom surface, plural discharge energy generating elements (for example, electrothermal converting elements) 104 for imparting discharge energy to the recording liquid are arranged on both sides of the through hole (the recording liquid supply port) 103 on the surface of the board 102, respectively. Further, a discharge port plate 105 is placed on the board 102, and plural discharge ports 106 facing the respective electrothermal converting elements are formed in the discharge port plate 105. Plural electrodes (not shown) are further provided on both end portions of the surface of the board 102, and the electrodes are electrically connected to the electrothermal converting elements, respectively.

Further, a support plate 109 is bonded to the upper surface of the support member 108, and a base film 124 comprising the flexible film wiring board 111 is bonded to the upper surface of the support plate 109 with resist 125. The flexible film wiring board 111 is electrically connected to the recording element board 101. A recess portion 117 formed between the support plate 109 and the recording element board 101 is protectively covered with first sealing resin 118 so as to prevent corrosion by the recording liquid and short circuit through the recording liquid. Furthermore, an electrical connecting portion between the electrode (not shown) on the recording element board 101 and an electrode lead (not shown) on the flexible film wiring board 111 is protectively covered with second sealing resin (not shown). Moreover, an outer periphery of the flexible film wiring board 111 bonded to the support plate 109 is protectively covered with third sealing resin 127 to prevent corrosion by the recording liquid.

Japanese Patent Application Laid-Open No. 2001-130001 discloses a conventional resin sealing method using the first sealing resin and the second sealing resin. In an ink jet recording head disclosed in this Japanese reference, after the first sealing resin is packed, the viscosity of the resin is lowered by raising its temperature up to temperatures a little above room temperature such that the resin can be liquidized and packed all over, and the resin is then thermally treated at curing temperature for a predetermined time. Alternatively, after the first sealing resin is liquidized and packed as described above, second sealing resin with higher viscosity and lower fluidity is laid on a predetermined place, and both the first and second resins are then thermally treated at curing temperature for a predetermined time.

In the thus-constructed conventional liquid jet recording head, the first heat treatment is for lowering the viscosity of the first sealing resin and fluidizing it, and the next heat treatment is for curing the overall sealing resins.

Further, Japanese Patent Application Laid-Open No. 2002-19120 discloses another conventional resin sealing method using the first sealing resin and the second sealing resin. In a liquid jet recording head disclosed in this Japanese reference, first resin having resiliency after cured or hardened is laid in recess portions formed between opening portions of the flexible film wiring board and the support plate, and the periphery of the recording element board, and second resin is then laid after the first resin is cured. The second resin is capable of strongly bonding and firmly covering the electrical connecting portion between the recording element board and the flexible film wiring board.

In the thus-constructed conventional liquid jet recording head (see FIGS. 19 and 20, for example), the first resin 18 packed in recess portions formed between opening portions of the flexible film wiring board and the support plate 9, and the periphery of the recording element board 1 has resiliency after cured, and accordingly even when the first resin is cured and contracted, there is no fear that cracks and the like occur in the recording element board 1. Further, since the electrical connecting portion between the recording element board 1 and the flexible film wiring board is sufficiently covered with the firm second resin 19, the electrical connecting portion is protected against external forces such as wiping force.

In other words, the first sealing resin 18 is required to have resiliency after cured and be capable of being packed even in a narrow space, and generally silicon-denatured epoxy resin can be optimally used as the first sealing resin. The second sealing resin 19 is required to effect protection from external forces such as wiping force, and cover an uneven electrical connecting portion under a smooth condition such that a wiper can be prevented from being damaged during the wiping operation, and therefore epoxy resin, especially dam agent (which is resin agent capable of being firm after cured and maintaining the shape subsequent to coating), is most suitable.

Further, in the construction of the head, when the first sealing resin 18 is laid in recess portions formed between opening portions of the flexible film wiring board and the support plate 9, and the periphery of the recording element board 1, the first sealing resin 18 is likely to go underneath the electrical connecting portion between the recording element board 1 and the flexible film wiring board, and the electrode lead 13 as well. Basically, this access is necessary access since portions underneath the electrical contact and the electrode lead 13 are planned to be sealed by such access. In order to gain access to a narrow space underneath the electrode lead 13, the access needs to be executed using the first sealing resin 18 having good fluidity. The second sealing resin 19 is the dam agent with poor fluidity, and therefore a narrow space, such as a space underneath the electrode lead 13, cannot be filled with the second sealing resin. Accordingly, two sealing resins have to be employed, and hence a boundary interface inevitably appears between the first sealing resin 18 and the second sealing resin 19 in the electrical connecting portion.

In the above-discussed structure, there exist the first sealing resin 18 and the second sealing resin 19, and the boundary interface between the first sealing resin 18 and the second sealing resin 19 in the electrical connecting portion, and therefore the electrical connecting portion needs to be completely sealed such that the interface can be protected against external attacks of ink and so forth.

Further, the above construction can be fabricated by a method in which after the recess portion is filled with the first resin 18, the electrical connecting portion is covered with the second resin 19, and the first resin 18 and the second resin 19 are then cured simultaneously. Thereby, its productivity efficiency can be improved as compared with the case where the first resin 18 and the second resin 19 are successively cured.

The first resin 18 can be thermosetting silicon-denatured epoxy resin, and the second resin 19 can be thermosetting epoxy resin.

The above-discussed conventional manufacturing methods of liquid jet recording heads, however, have the following disadvantages.

After the first sealing resin (thermosetting silicon-denatured epoxy resin) 18 is laid, the second sealing resin (thermosetting epoxy resin) 19 is superposed on the uncured first sealing resin 18. The two sealing resins are then cured simultaneously. For this reason, a compatible layer 29 is formed at a boundary portion between the first sealing resin 18 and the second sealing resin 19. Cases may occur where curing obstruction occurs and the compatible layer 29 cannot be cured enough to seal a necessary portion.

Further, the boundary layer (a bonded interface) between the first sealing resin 18 and the second sealing resin 19 is present in the electrical connecting portion in the above structure, and accordingly electrical connecting defects threaten to occur due to undesired access of ink and the like from the outside if the compatible layer 29 establishes communication between the outside and the electrode lead 13, or the electrical connecting portion (see FIG. 19).

In order to solve such disadvantages, it can be considered that the first sealing resin 18 is laid covering the electrical connecting portion and the electrode lead 13 such that the boundary layer between the first sealing resin 18 and the second sealing resin 19 cannot go over the electrical connecting portion.

However, if the second sealing resin 19 is laid after the first sealing resin is laid under its uncured condition, the second sealing resin 19 is liable to sink in the first sealing resin 18 and reach the electrode lead 13 and the electrical connecting portion. Resultantly, the boundary layer between the first sealing resin 18 and the second sealing resin 19 is still likely to appear in the electrical connecting portion. When the compatible layer 29 exists in such boundary layer, the electrical defect likewise occurs.

Furthermore, in order to solve the above disadvantages, it can be considered that the second sealing resin 19 is laid after the first sealing resin 18 is completely cured. However, if the first sealing resin 18 is completely cured, its retraction is likely to appear between leads and the like due to its curing contraction. The second sealing resin 19 having high viscosity serving as the dam agent cannot enter the retraction portion, and air voids are likely to appear in the electrode leads 13 and the electrical connecting portion to lower the sealing function. Further, the air void is likely to expand and rupture when the overall sealing resin is completely cured, and holes are likely to be created in the second sealing resin 19, thereby damaging the sealing function.

Additionally, in the method wherein the first sealing resin 18 is completely cured, two curing steps for complete curing are needed for the first sealing resin 18 and the second sealing resin 19, respectively. Accordingly, its productivity efficiency is remarkably lowered.

As described in the foregoing, the first sealing resin 18 and the second sealing resin 19 need to have different characteristics and functions in the light of the head structure. Therefore, similar problems are posed in connection with the bonding between different sealing resins, like the case where the above-discussed silicon-denatured epoxy rein and epoxy resin are used.

SUMMARY OF THE INVENTION

It is an object of the present invention to provide a manufacturing method of a liquid jet recording head in which even when a sufficient amount of sealing resin is laid to fill a recess portion at the periphery of a recording element board, no damages of the recording element board due to curing and contraction of the sealing resin occur, and an electrical connecting portion between the recording element board and a flexible film wiring board can be protected against external forces such as wiping force.

It is another object of the present invention to provide a manufacturing method of a liquid jet recording head in which no boundary layer (interface) between first and second sealing resins is formed in an electrical connecting portion, necessary bonding forces at interfaces are strengthened in both a portion between the different sealants and their boundary layer such that sealing characteristic against liquids such as ink can be improved, and electrical reliability of the head can hence be improved.

It is still another object of the present invention to provide a manufacturing method of a liquid jet recording head in which first and second sealing resins are simultaneously cured in a sealing step of the head such that its productivity efficiency can be enhanced.

It is still another object of the present invention to provide a manufacturing method of a liquid jet recording head in which after first sealing resin is laid covering an electrical connecting portion between a plurality of electrode leads provided on a flexible film wiring board and a plurality of electrodes provided on a recording element board and a surface of the first sealing resin is then cured (membrane-cured) in a membrane form, the electrical connecting portion is covered with second sealing resin.

It is yet still another object of the present invention to provide a manufacturing method of a liquid jet recording head in which after first sealing resin is laid covering an electrical connecting portion between a plurality of electrode leads provided on a flexible film wiring board and a plurality of electrodes provided on a recording element board and a surface of the first sealing resin is then cured in a membrane form, the electrical connecting portion is covered with second sealing resin, and the overall first and second sealing resins are then cured.

These and further aspects and features of the invention will become apparent from the following detailed description of preferred embodiments thereof in conjunction with the accompanying drawings.

DESCRIPTION OF THE PREFERRED EMBODIMENTS

Embodiments according to the present invention will hereinafter be described with reference to the drawings.

Figure 1A:
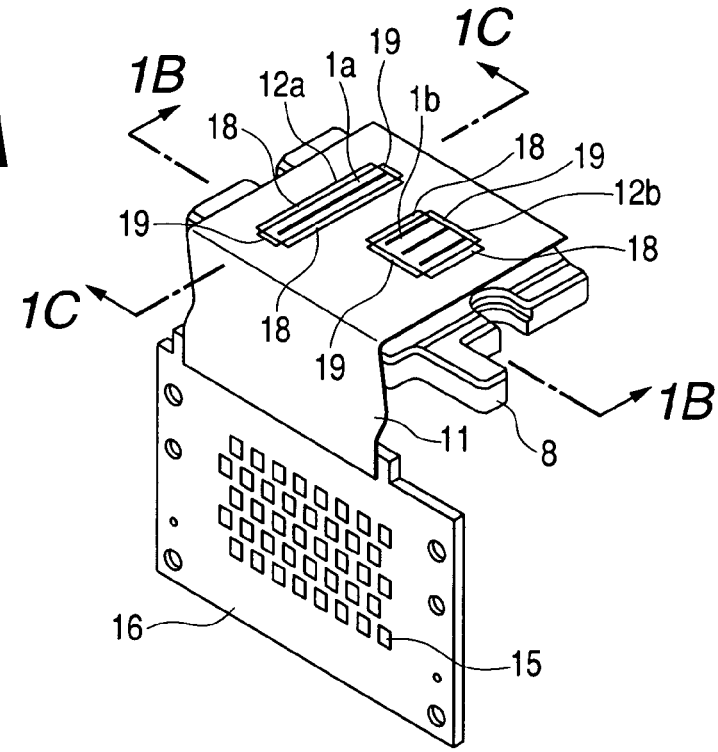
FIGS. 1A, 1B and 1C are views illustrating a recording element unit in an embodiment of a liquid jet recording head according to the present invention.
Figure 1B:
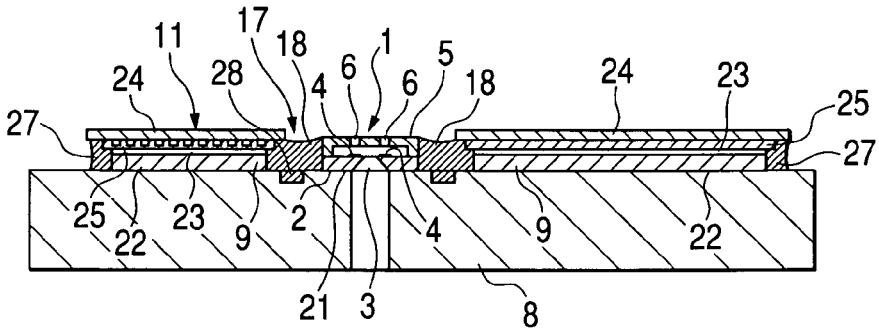
Figure 1C:
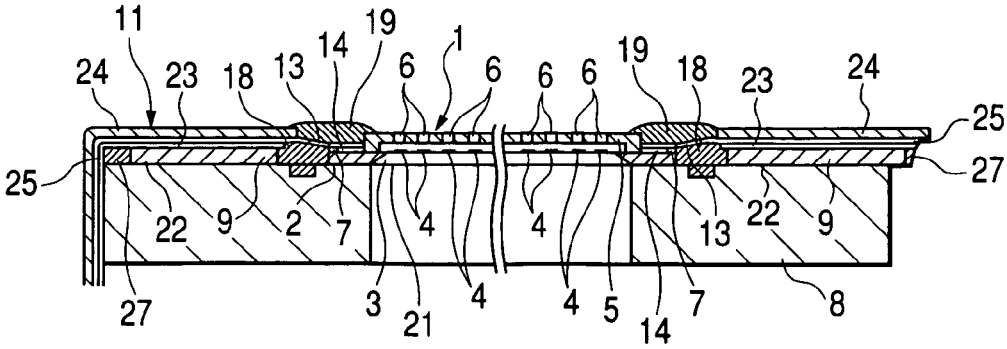

FIGS. 1A to 1C are views illustrating a recording element unit which is a portion of an embodiment of a liquid jet recording head according to the present invention. FIG. 1A is a perspective view illustrating the recording element unit, FIG. 1B is a cross-sectional view taken along the line 1B—1B of FIG. 1A, and FIG. 1C is a cross-sectional view taken along the line 1C—1C of FIG. 1A.

As illustrated in FIGS. 1A to 1C, the recording element unit in the liquid jet recording head of the present invention includes plural recording element boards 1*a* and 1*b* with different shapes and sizes (in this embodiment two recording element boards are shown for the convenience of simplicity), a support member 8 for supporting and fixing the recording element boards 1*a* and 1*b* thereto, a flexible film wiring board 11, and a support plate 9 for supporting and fixing the flexible film wiring board 11 with being interposed between the support member 8 and the flexible film wiring board 11.

In a discharge port plate 5 provided on a surface side of each of the recording element boards 1*a* and 1*b*, two arrays of plural discharge ports 6 for discharging recording liquid are formed at places facing corresponding discharge energy generating elements (for example, electrothermal converting elements) 4 of recording elements. In a central portion of each of the recording element boards 1*a* and 1*b* on its bottom surface side, a recording liquid supply port 3 for supplying the recording liquid is opened with its length approximately equal to a length in the arrangement direction of the discharge ports 6.

Further, as illustrated in FIG. 1C, plural electrodes 7 are provided on both end portions of each of the recording element boards 1 (1*a* and 1*b*), and the electrodes 7 are electrically connected to the discharge energy generating elements 4, respectively. On each electrode 7, a stud bump 14 is provided using a gold wire which is conventionally used. Although the stud bump is used in the first embodiment, the bump structure is not limited thereto. Solder bump or plated bump can also be used with the same effect, for example. Bottom surface sides of those recording element boards 1*a* and 1*b* are disposed closely to the surface of the support member 8 for a recording liquid supply member, and the recording element-boards 1*a* and 1*b* are bonded and fixed to predetermined places with high precision from several microns to several tens microns. FIGS. 1B and 1C exemplify several discharge ports 6 and electrodes 7, but actually several tens to several hundreds of ports 6 and electrodes 7 are provided.

In FIGS. 1B and 1C, reference numeral 2 designates a board which constitutes the recording element board 1 and supports the energy generating element 4. Reference numeral 24 designates a base film which constitutes the flexible film wiring board 11. Reference numeral 25 designates resist.

As is seen from FIG. 1A, the flexible film wiring board 11 is provided with two opening portions 12*a* and 12*b* to which two recording element boards 1*a* and 1*b* are assembled in exposed states, respectively. In order that the two recording element boards 1*a* and 1*b* are electrically implemented, electrode leads 13 for electrical connection with the electrodes 7 of each recording element board 1 are formed around each of the opening portions 12*a* and 12*b*. The number of the electrode leads 13 is equal to that of the electrodes 7. Those electrode leads 13 are electrically connected to the electrodes 7 of each recording element board 1 via the stud bumps 14, respectively. Such connection is achieved by applying appropriate load and ultrasonic vibration to the electrical connecting portion under its heated condition in a range from 160° C. to 200° C. for a predetermined period to create intermetallic bonding between contact surfaces of the gold bump on the electrode 7 and gold-plated electrode lead 13 formed on the flexible film wiring board 11. In this embodiment, the above-discussed single point bonding method is used, but other bonding methods can also be employed. They are a gang bonding method of performing simultaneous bonding of the overall connecting portions using a thermal pressure bonding unit, a reflow method of melting a solder bump, a wire bonding method of connecting corresponding electrodes by wires, a conventional ACF bonding method, and the like. An optimal method is selected among them, considering an available production line.

Figure 32:
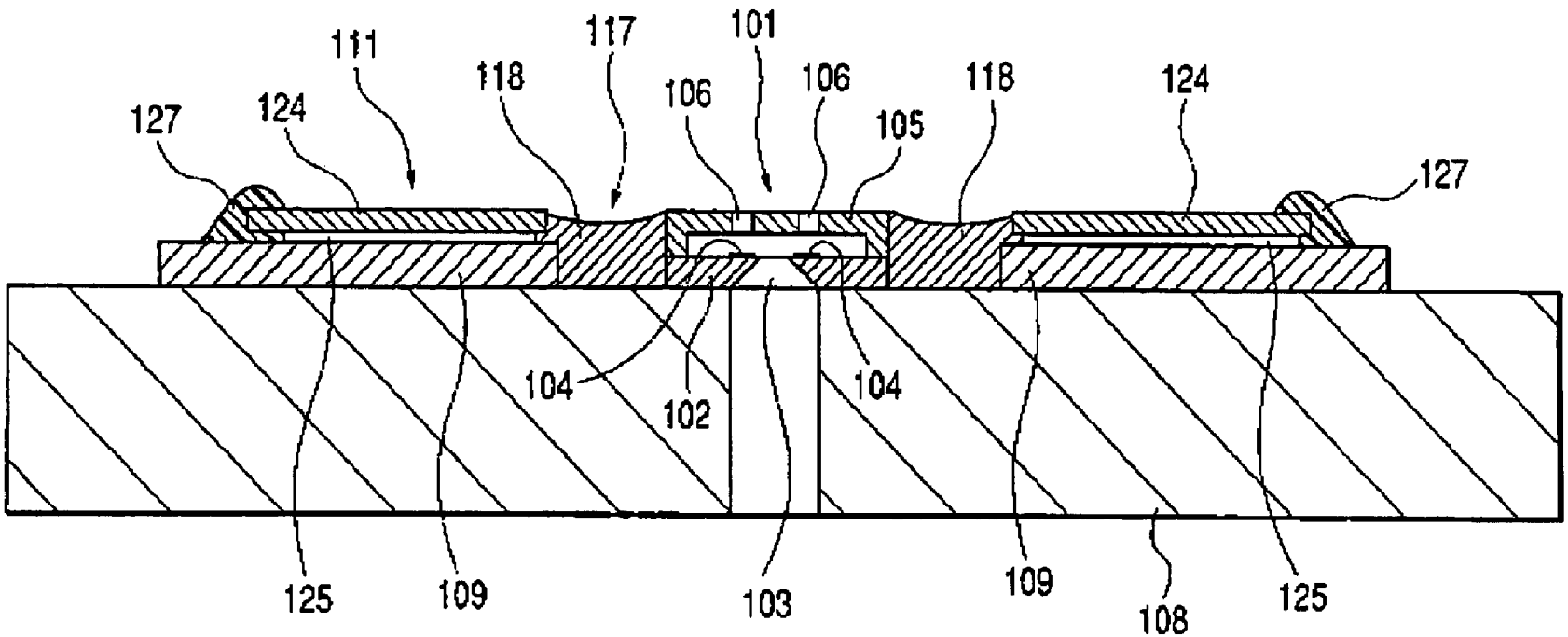
FIG. 32 (PRIOR ART)
FIG. 32 is a cross-sectional view illustrating another conventional liquid jet recording head.

In the above recording element unit, the flexible film wiring board 11 completely covers the support plate 9, extends a predetermined amount beyond the periphery of the support plate 9 in the form of eaves as illustrated in FIG. 1C, and is bonded and fixed to the support plate 9. Therefore, utilizing capillary attraction present in a region surrounded by the bottom surface of the extending portion of the flexible film wiring board 11, the periphery of the support plate 9, and the surface of the support member 8, resin (third sealing resin) 27 can be caused to flow into the overall periphery of the flexible film wiring board 11 by supplying the resin 27 through one place at the periphery of the flexible film wiring board 11. The resin 27 serving as the third sealing resin is preferably a material that has such a low viscosity that when a predetermined amount thereof is laid at a predetermined location, it then extends of itself toward the periphery of the flexible film wiring board 11 due to the capillary attraction. For example, thermosetting silicon-denatured epoxy resin produced by Nihon Rec Co., Ltd. (its trade name is NR200C), or the like is most preferable. Sealant of such material can be laid without protruding from the surface of the flexible film wiring board 11 as illustrated in FIG. 32.

Further, the first thermosetting sealing resin 18 is laid to protect the recess portion 17 formed between each of the opening portions 12*a* and 12*b* of the flexible film wiring board 11, an opening portion 10 of the support plate 9, and the periphery of the recording element board 1, and a portion (the periphery of the stud bump 14 and a portion underneath the electrode lead 13) of the electrical connecting portion between the plural recording element board 1 and the flexible film wiring board 11. As the first thermosetting sealing resin 18, it is preferable to use such a thermosetting sealant as has resiliency still after subjected to curing treatment, such as the above-noted NR200C. In the first embodiment, the same material is used as the first sealing resin 18 and the third sealing resin 23 such that the resin sealing process can be simplified. Additionally, a groove 28 is formed surrounding the periphery of each of the recording element boards 1*a* and 1*b* in a portion facing the recess portion 17 on the surface of the support member 8. The groove 28 makes it easy for the sealing resin 18 injected into the recess portion 17 to circumvent the overall circumference of the recess portion 17.

Furthermore, the second thermosetting sealing resin 19 covers and protects an upper portion (a region including a region from the flexible film wiring board 11 to the discharge port plate 5 with the electrodes 13 being interposed) of the electrical connecting portion between the plural recording element boards 1 and the flexible film wiring board 11. As the second thermosetting sealing resin 19, it is preferable to use such a thermosetting sealant as has a very strong hardness after subjected to curing treatment, and has mechanical strength, such as thermosetting epoxy resin produced by Matsushita Electric Works, Ltd. (its trade name is CV5420D).

After the first sealing resin 18 is laid, it is cured in a membrane form (i.e., as described later, a cured condition under which only the membrane surface of resin is cured, and its inner portion still has fluidity). Then, after the second sealing resin 19 is laid, both the first sealing resin 18 and the second sealing resin 19 are completely cured (i.e., a cured condition under which overall resin is completely cured, but not the above-mentioned membrane-cured condition in the membrane form). In this embodiment, the applied first sealing resin 18 is cured in the membrane form at 100° C. for 4 hours, and the second sealing resin 19 is then laid. Thereafter, both the first sealing resin 18 and the second sealing resin 19 are completely cured simultaneously at 150° C. for 3.5 hours.

The flexible film wiring board 11 is electrically connected to a second wiring board 16 equipped with a plurality of external input pads 15 for supplying electrical signals, such as recording information, from a body side of the recording apparatus to the liquid jet recording head. It is naturally possible to construct the flexible film wiring board 11 and the second wiring board 16 on a common board in the form of a united unit. The flexible film wiring board 11 is bent along and boded to a recording liquid supply member (not shown).

In the thus-constructed liquid jet recording head of the first embodiment, the first resin 18 applied to recess portions formed between opening portions of the flexible film wiring board 11 and the support plate 9, and the periphery of the recording element board 1 has resiliency after subjected to curing treatment, and accordingly even when the first resin 18 is cured and contracted, there is no fear that cracks and the like occur in the recording element board 1. Further, since the electrical connecting portion between the recording element board 1 and the flexible film wiring board 11 is covered with the second resin 19, the electrical connecting portion is protected against external forces such as wiping force.

Further, the flexible film wiring board 11 completely covers the upper surface of the support plate 9, and extends beyond the periphery of the support plate 9 in the form of eaves, so that the third resin 27 can be laid on the bottom surface (the surface facing the support member 8) of the eaves-like extending portion of the flexible film wiring board 11. Therefore, it is possible to prevent the third resin 27 from sticking to a heater (not shown) for thermally pressure-bonding the flexible film wiring board 11 to the support plate 9, or to prevent the third resin 27 from protruding to the surface side of the flexible film wiring board 11 and coming in contact with a recording medium (not shown) to lower its printing quality.

A manufacturing method of the above-discussed liquid jet recording head will be described mainly with reference to FIGS. 1A to 1C.

In the manufacturing method, the support plate 9 is initially bonded to a predetermined location on the support member 8 using adhesive resin 22.

The recording element board 1 is then bonded to a predetermined location on the support member 8 through the opening portion of the support plate 9 using adhesive resin 21. The flexible film wiring board 11 is then boded on the support plate 9 with adhesive resin 23 in such a manner that the wiring board 11 can completely cover the upper surface of the support plate 9, and the periphery of the wiring board 11 can extend beyond the periphery of the support plate 9.

After that, electrode leads of the flexible film wiring board are electrically connected to the respective electrode pads of the recording element board 1.

The first sealing resin 18 having resiliency after cured is applied in the recess portion formed between opening portions of the flexible film wiring board 11 and the support plate 9, and the periphery of the recording element board 1 (see FIG. 1B), and the first sealing resin 18 is cured in the membrane manner. Thereafter, the electrical connecting portion between the recording element board 1 and the flexible film wiring board 11 is further covered with the second sealing resin 19 (see FIG. 1C).

Then, the third sealing resin 27 is supplied only to one place at the periphery of the flexible film wiring board 11. The third sealing resin 27 is laid on the overall periphery of the flexible film wiring board 11 by causing the third sealing resin 27 to flow into the overall periphery of the flexible film wiring board 11, utilizing the capillary attraction present in a region between the surface, which faces the support member 8, of the eaves-like extending portion of the flexible film wiring board 11, the periphery of the support plate 9, and the surface of the support member 8 facing the flexible film wiring board 11.

The first sealing resin 18, the second sealing resin 19, and the third sealing resin 27 are completely cured at the same time.

Description will made of the structures of a head cartridge, a recording head, and an ink tank to which the present invention can be preferably applied, and their relationships with reference to the drawings.

Figure 2:
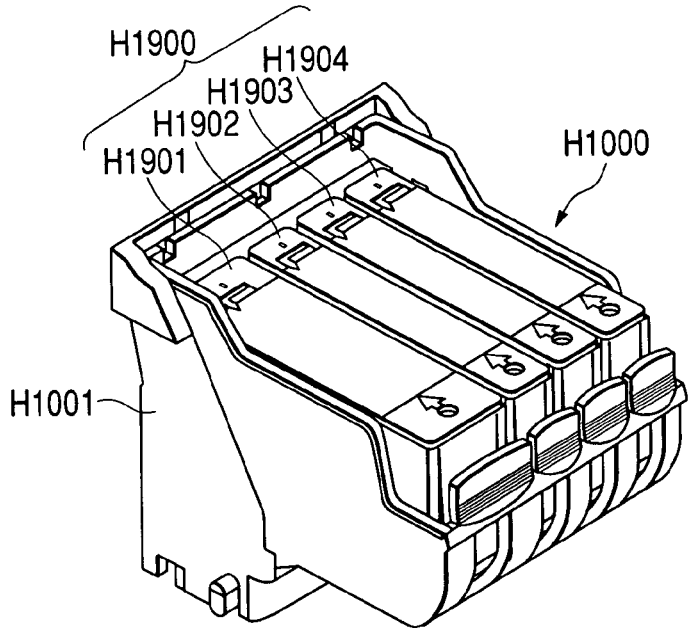
FIG. 2 is a perspective view illustrating a combination of a recording head and an ink tank in an embodiment of a recording head cartridge according to the present invention.
Figure 3:
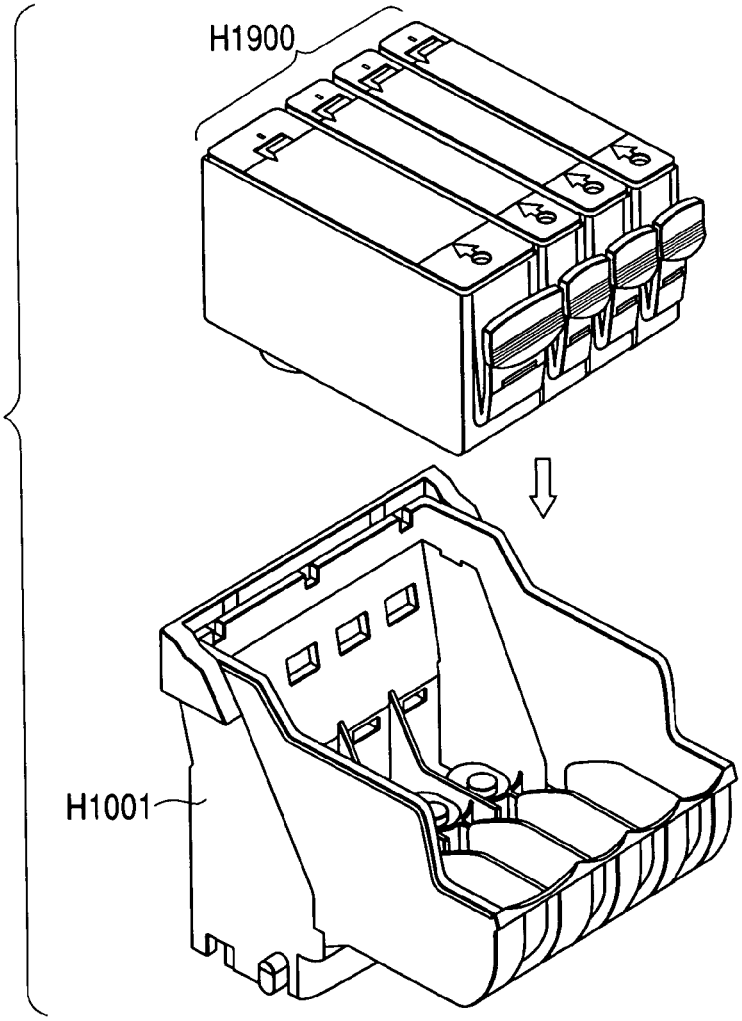
FIG. 3 is a perspective view illustrating separated recording head and ink tank in an embodiment of a recording head cartridge according to the present invention.

FIGS. 2 and FIG. 3 are perspective views illustrating an embodiment of a recording head cartridge of the present invention. FIG. 2 illustrates combined recording head and ink tank of the embodiment. FIG. 3 illustrates separated recording head and ink tank of the embodiment.

As is seen from FIGS. 2 and FIG. 3, a recording head H1001 of this embodiment is a component constituting a recording head cartridge H1000. The recording head cartridge H1000 is comprised of the recording head H1001, and ink tanks H1900 (H1901, H1902, H1903 and H1904) mounted on the recording head H1001 in a detachable and attachable manner. The recording head cartridge H1000 is supported by and fixed to a positioning unit and electrical contacts on a carriage (not shown) provided on a body of the ink jet recording apparatus, and is detachably attached to the carriage. The ink tanks H1901, H1902, H1903 and H1904 are for black ink, cyan ink, magenta ink, and yellow ink, respectively. Each of those ink tanks H1901, H1902, H1903 and H1904 is thus attachable and detachable to the recording head H1001, and each ink tank is exchangeable for another. Accordingly, only the ink tank with little remainder can be individually exchanged for another. The running cost of image recording by the ink jet recording apparatus can hence be reduced.

Turning now to the recording head H1001, its entire structure and constituent components will be described.

[1] Recording Head

The recording head H1001 is a bubble jet recording head of a so-called side shoot type in which recording is performed using an electrothermal converter for generating thermal energy for boiling ink in a membrane manner in accordance with electrical signals.

Figure 4:
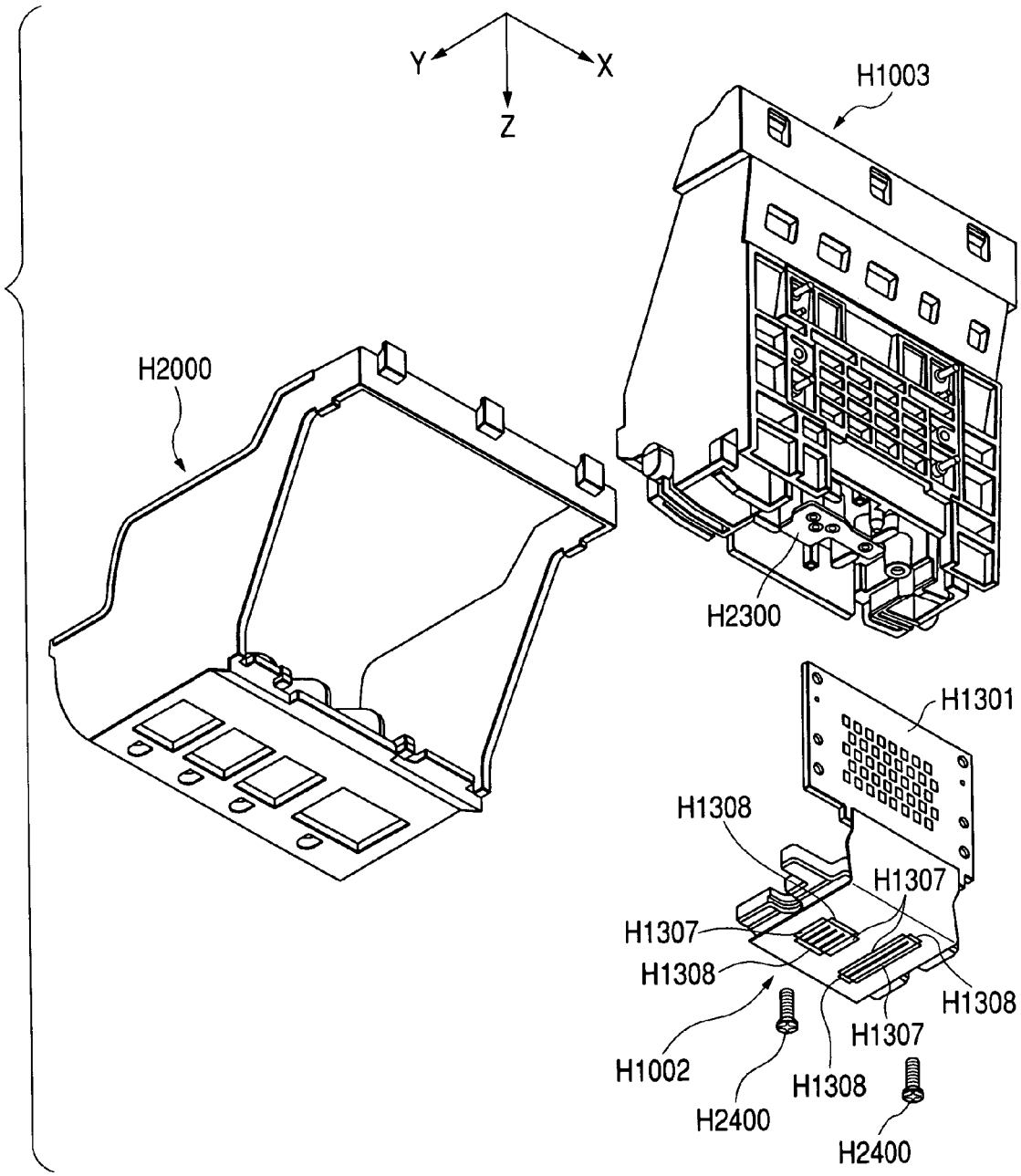
FIG. 4 is a disassembled perspective view illustrating the recording head cartridge illustrated in FIG. 2, for example.

As illustrated in a disassembled perspective view of FIG. 4, the recording head H1001 is comprised of a recording element unit H1002, an ink supply unit H1003, and a tank holder H2000. Denoted at H1307 and H1308 are first sealant and second sealant, respectively.

Figure 5:
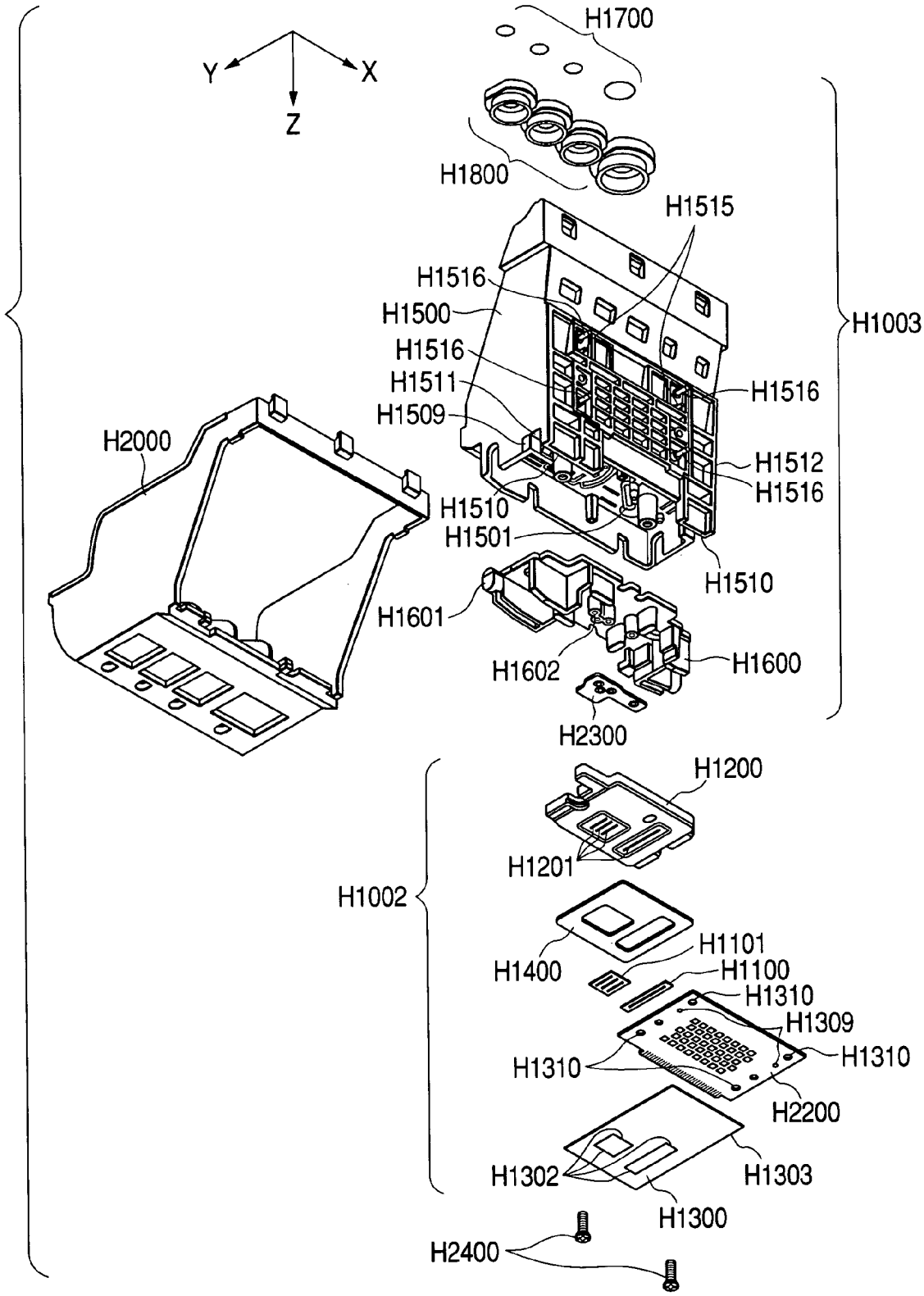
FIG. 5 is a disassembled perspective view illustrating an ink supply unit and a recording element unit illustrated in FIG. 4.

Further, as illustrated in a disassembled perspective view of FIG. 5, the recording element unit H1002 is comprised of a first recording element board H1100, a second recording element board H1101, a first plate H1200, an electrical wiring tape H1300, an electrical contact board H2200, and a second plate H1400. The ink supply unit H1003 is comprised of an ink supply member H1500, a flow path forming member H1600, a joint rubber H2300, a filter H1700, and a seal rubber H1800. Denoted at H1310 is a terminal connecting hole.

(1) Recording Element Unit

Figure 6:
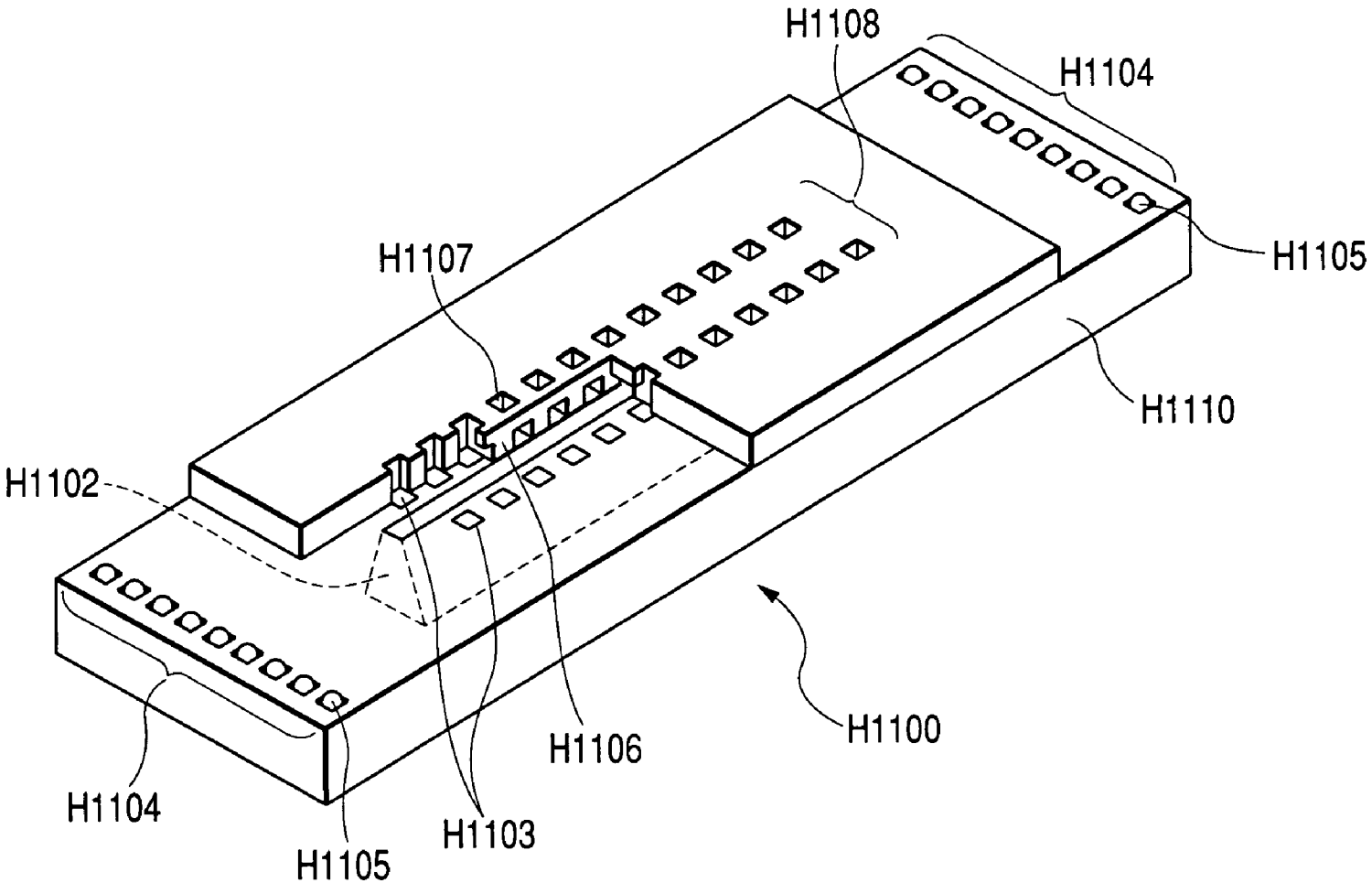
FIG. 6 is a partially-cut-away perspective view illustrating a first recording element board illustrated in FIG. 1, for example.

FIG. 6 is a partially-cut-away perspective view illustrating the first recording element board H1100.

In the first recording element board H1100, an ink supply port H1102 of an elongate penetrating groove serving as the ink flow path is formed in a Si board H1110 having a thickness of 0.5 mm to 1 mm, by a method, such as an anisotropic etching using Si crystal orientation, or sand blasting. Further, arrays of electrothermal converting elements H1103 are arranged on both sides of the ink supply port H1102 in a zigzag form, respectively. The electrothermal converting elements H1103, and electrical wires of Al or the like for supplying electrical power to the electrothermal converting elements H1103 are formed by film-forming techniques. Electrode portions H1104 for supplying electrical power to the electrical wires are arranged on both outer sides of the electrothermal converting elements H1103, and bumps H1105 of Au or the like are formed on the electrode portions H1104. Furthermore, on the Si board H1110, an ink flow path wall H1106 and a discharge port H1107 for forming the ink flow path corresponding to each electrothermal converting element H1103 are formed with resin material by photolithography techniques, and a discharge port group H1108 is thus formed. Since the discharge port is provided facing the electrothermal converting element H1103 as described above, ink supplied from the ink flow path H1102 is discharged due to the bubble generated by the electrothermal converting element H1103.

Figure 7:
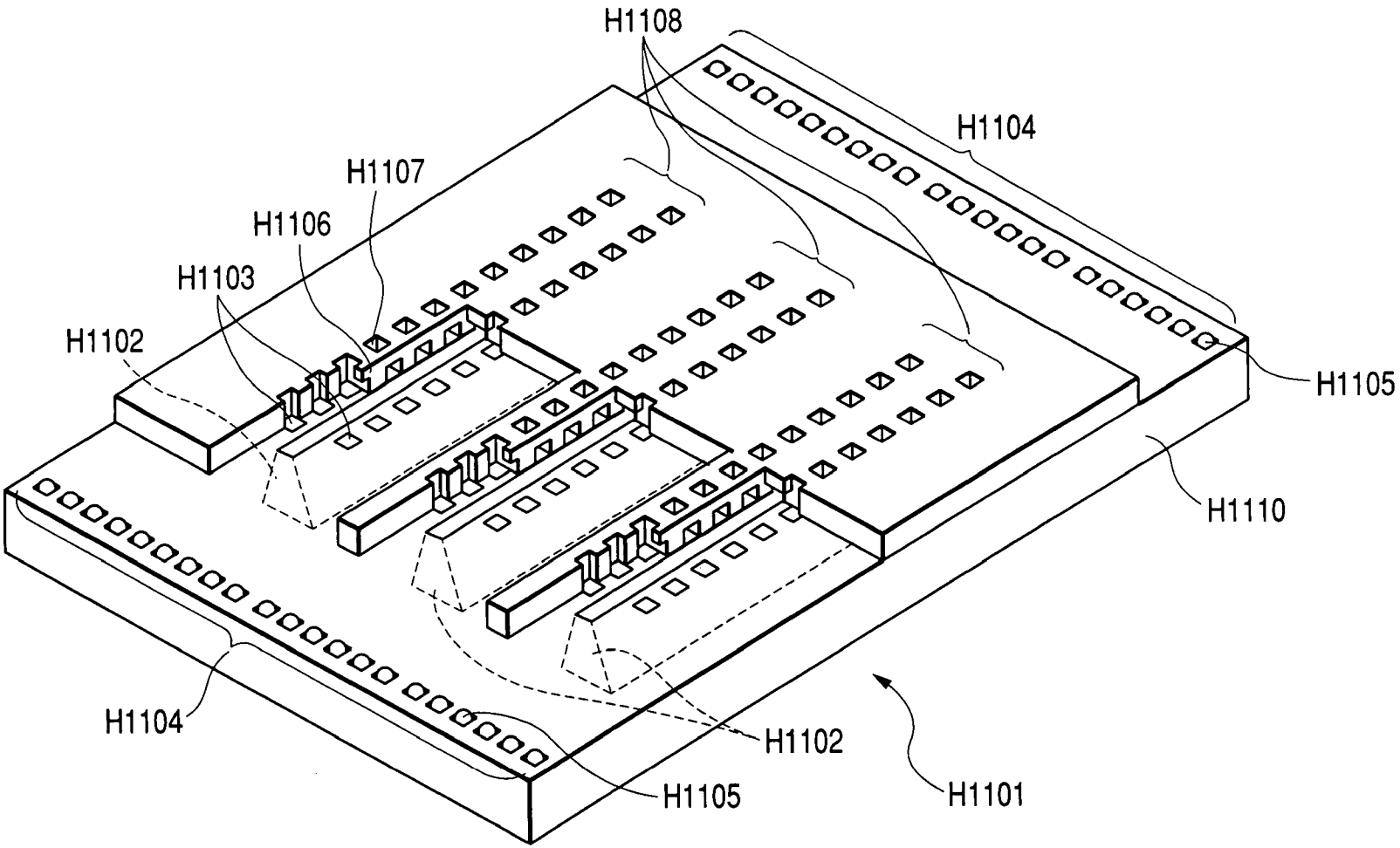
FIG. 7 is a partially-cut-away perspective view illustrating a second recording element board illustrated in FIG. 1, for example.

FIG. 7 is a partially-cut-away perspective view illustrating the second recording element board H1101.

The second recording element board H1101 is a recording element board for discharging three color inks in which three ink discharge ports H1102 are juxtaposed, and electrothermal converting elements and ink discharge ports are formed on both sides of each ink supply port. Similarly to the first recording element board H1100, ink supply ports, electrothermal converting elements, electrical wires, electrode portions, and the like are formed on a Si board, and ink flow paths and ink discharge ports are formed thereon with resin material by photolithography techniques. Further, similarly to the first recording element board H1100, bumps H1105 of Au or the like are formed on the respective electrode portions H1104 for supplying electrical power to the electrical wires.

Turning again to FIG. 5, the first plate H1200 is composed of an alumina ($Al_2O_3$) material having a thickness from 0.5 mm to 10 mm, for example. The material of the first plate H1200 is not limited to alumina. It is also possible to use such material as has a coefficient of linear expansion substantially equal to that of the material of the recording element board H1100, and as has a thermal conductivity equal to or larger than that of the material of the recording element board H1100. Material of the first plate H1200 can be any of silicon (Si), aluminum nitride (AlN), zirconia ($ZrO_2$), silicon nitride ($Si_3N_4$), silicon carbide (SiC), molybdenum (Mo), and tungsten (W), for example.

In the first plate H1200, there are formed an ink supply port for supplying black ink to the first recording element board H1100, and ink supply ports H1201 for supplying cyan ink, magenta ink and yellow ink to the second recording element board H1101. The ink supply ports 1102 on the recording element board correspond to the ink supply ports H1201 of the first plate H1200, respectively, and each of the first and second recording element boards H1100 and H1101 is bonded and fixed to the first plate H1200 with high positional precision. The first adhesive used for such bonding is desirably an adhesive which has a low viscosity, has a low curing temperature, can be cured in a short time, has a relatively high hardness after subjected to curing treatment, and is resistant to ink. The first adhesive is, for example, a thermosetting adhesive whose principal constituent is epoxy resin, and desirably has a thickness less than about 50 microns.

The electrical wiring tape H1300 is a resilient wiring member in which there are formed electrical wires for applying electrical signals for discharging ink to the first recording element board H1100 and the second recording element board H1101. The electrical wiring tape H1300 includes plural opening portions for assembling the respective recording element boards therein, electrode terminals H1302 corresponding to the electrode portions H1104 of the respective recording element boards, and electrode terminal portions H1303 for executing electrical connection to the electrical contact board H2200 equipped with external signal input terminals for receiving electrical signals from a body of the apparatus. The electrode terminal portion H1303 is provided at the end portion of the electrical wiring tape H1300. Electrode terminals H1302 and electrode terminal portions are connected by a wiring pattern formed of continuous cupper foil.

The electrical wiring tape H1300, the first recording element board H1100, and the second recording element board H1101 are electrically connected to each other. Those are connected by electrically bonding the electrode portions 1104 of the recording element board and the electrode terminals H1302 of the electrical wiring tape H1300 using a thermal ultrasonic-wave pressure bonding method, for example.

The second plate H1400 is composed of a planer material with a thickness from 0.5 mm to 1 mm, for example, and is formed of a metal material, such as ceramics of alumina ($Al_2O_3$) or the like, Al, and SUS (stainless steel).

The second plate H1400 has opening portions which are larger than outline sizes of the first recording element board H1100 and the second recording element board H1101, respectively, and are bonded to and fixed to the first plate H1200. The second plate H1400 is bonded to the first plate H1200 with the second adhesive such that the first recording element board H1100 and the second recording element board H1101 can be electrically connected to the electrical wiring tape H1300 in a planer form. Further, the bottom surface of the electrical wiring tape H1300 is bonded to and fixed to the second plate H1400 with the third adhesive.

The electrical connecting portions between the first and second recording element boards H1100 and H1101, and the electrical wiring tape H1300 are sealed by the first and second sealing resins 18 and 19 as illustrated in FIG. 1C so as to be protected against corrosion by ink and external shocks. The first sealing resin 18 mainly seals the connecting portion between the electrode terminal H1302 of the electrical wiring tape H1300 and the electrode portion H1105 of the recording element board, and the peripheral portion of the recording element board, while the second sealing resin 19 further covers the first sealing resin laid on that connecting portion. In FIG. 1C, the electrode lead 13 lies at the boundary portion between the first and second sealing resins 18 and 19. However, in the case where the applying amount of the first sealing resin 18 is small, for example, this boundary is located underneath the electrode lead 13.

Further, the electric contact board H2200 with the external signal input terminal for receiving electrical signals from the apparatus body is thermally pressure-bonded to and electrically connected to the end portion of the electrical wiring tape H1300 using an anisotropic electrically-conductive film or the like.

The electrical wiring tape H1300 is bent at one side face of the first plate H1200, and is bonded to the side face of the first plate H1200 with the third adhesive. The third adhesive can be a thermosetting adhesive whose principal constituent is epoxy resin, and whose thickness is from 10 microns to 100 microns, for example.

(2) Ink Supply Unit

The ink supply member H1500 as illustrated in FIG. 5 is formed by resin molding, for example. It is desirable to use as this resin material a resin material in which glass filler of 5% to 40% is mixed to improve its shaping rigidity As illustrated in FIGS. 5 to 8, the ink supply member H1500 is a component of the ink supply unit H1003 for guiding ink from the ink tank H1900 to the recording element unit H1002. The flow path forming member H1600 for forming the ink flow path H1501 is fusion-bonded to the ink supply member H1500 using ultrasonic waves. Further, the filter H1700 for preventing dust particles from entering from the outside is fusion-bonded to a joint portion H1520 for engagement with the ink tank H1900, and a sealing rubber H1800 is installed to prevent evaporation of ink through the joint portion H1520.

The ink supply member H1500 further has a function of supporting the detachably attached ink tank H1900, and has a first hole H1503 for engagement with a second claw H1910 of the ink tank H1900.

Further, the ink supply member H1500 includes a loading guide H1601 for guiding the recording head cartridge H1000 to a loading location of the carriage of the ink jet recording apparatus body, an engagement portion for loading and fixing the recording head cartridge H1000 to the carriage by a head set lever, and an X-direction (a carriage scanning direction) abutment portion H1509, a Y-direction (a recording medium conveying direction) abutment portion H1510, and a Z-direction (an ink discharge direction) abutment portion H1511 for positioning the carriage in a predetermined loading position. The ink supply member H1500 further includes a terminal fixing portion H1512 for positioning and fixing the electrical contact board H2200 of the recording element unit H1002, and plural ribs are provided in and around the terminal fixing portion H1512 to enhance the rigidity of a plane having the terminal fixing portion H1512.

(3) Connection Between Recording Head Unit and Ink Supply Unit

As illustrated in FIG. 4, the recording head H1001 is constructed by connecting the recording element unit H1002 to the ink supply unit H1003, and connecting the ink supply unit H1003 to the tank holder H2000. The connection is accomplished in the following manner.

In order that the ink supply port (the ink supply port H1201 of the first plate H1200) of the recording element unit H1002 is coupled to the ink supply port (the ink supply port H1602 of the flow path forming member H1600) of the ink supply unit H1003 without any leak of ink, these members H1002 and H1003 are fixed to each other by set screws H2400 under a condition under which they are pressure-bonded to each other through a joint rubber H2300. At the same time the recording element unit H1002 is fixed to the ink supply unit 1003 with being accurately positioned relative to reference positions of the ink supply unit in the X-, Y-, and Z-directions.

Figure 9:
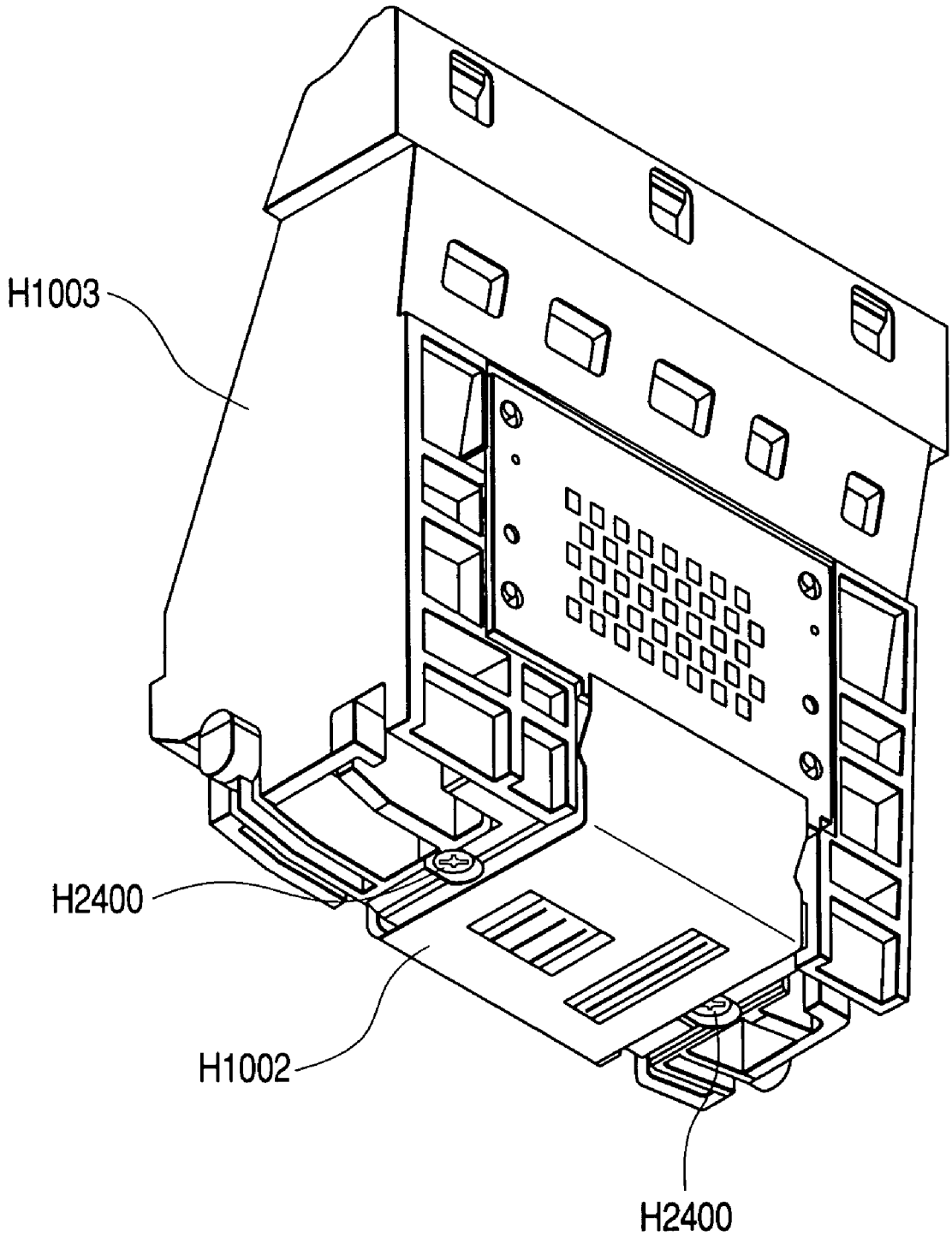
FIG. 9 is a perspective view illustrating a combination of the ink supply unit and the recording element unit in the recording head cartridge illustrated in FIG. 2, for example.

The electrical contact board H1301 of the recording element unit H1002 is fixed to one side surface of the ink supply member H1500 with being positioned by terminal positioning pins H1515 (two places) and terminal positioning holes H1309 (two places). This fixation is executed by caulking using the terminal connecting pins H1515 provided in the ink supply member H1500, for example. Other fixing means can be used for this fixation. A combination of the recording element unit H1002 and the ink supply unit H1003 as illustrated in FIG. 9 is constructed by the above-discussed steps.

Figure 10:
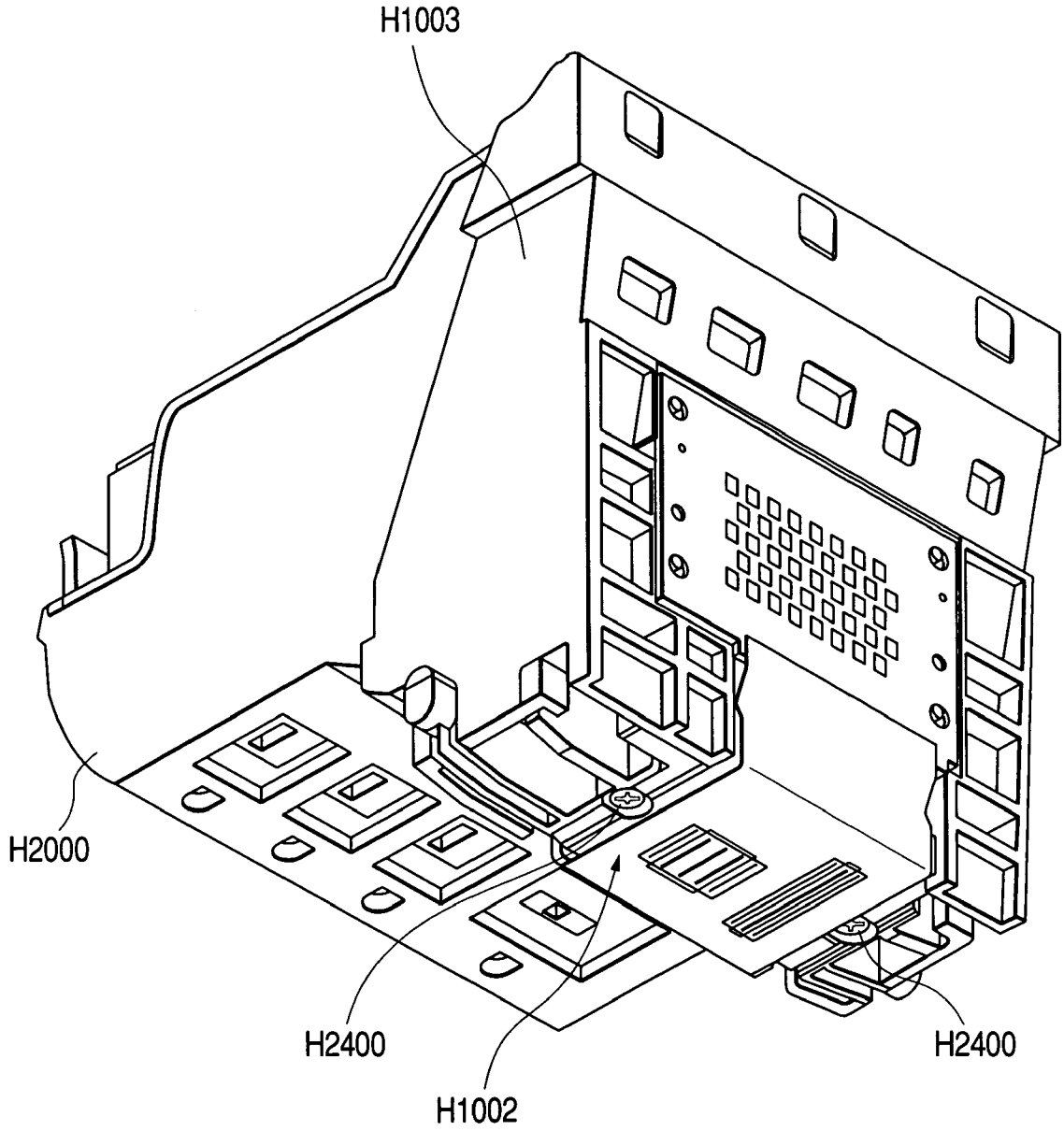
FIG. 10 is a perspective view illustrating a bottom surface of the recording head cartridge illustrated in FIG. 2, for example.

Further, the recording head H1001 as illustrated in FIG. 10 is accomplished by fitting and connecting the connecting hole and the connecting portion of the ink supply member H1500 to the tank holder H2000.

[2] Recording Head Cartridge

Figure 8:
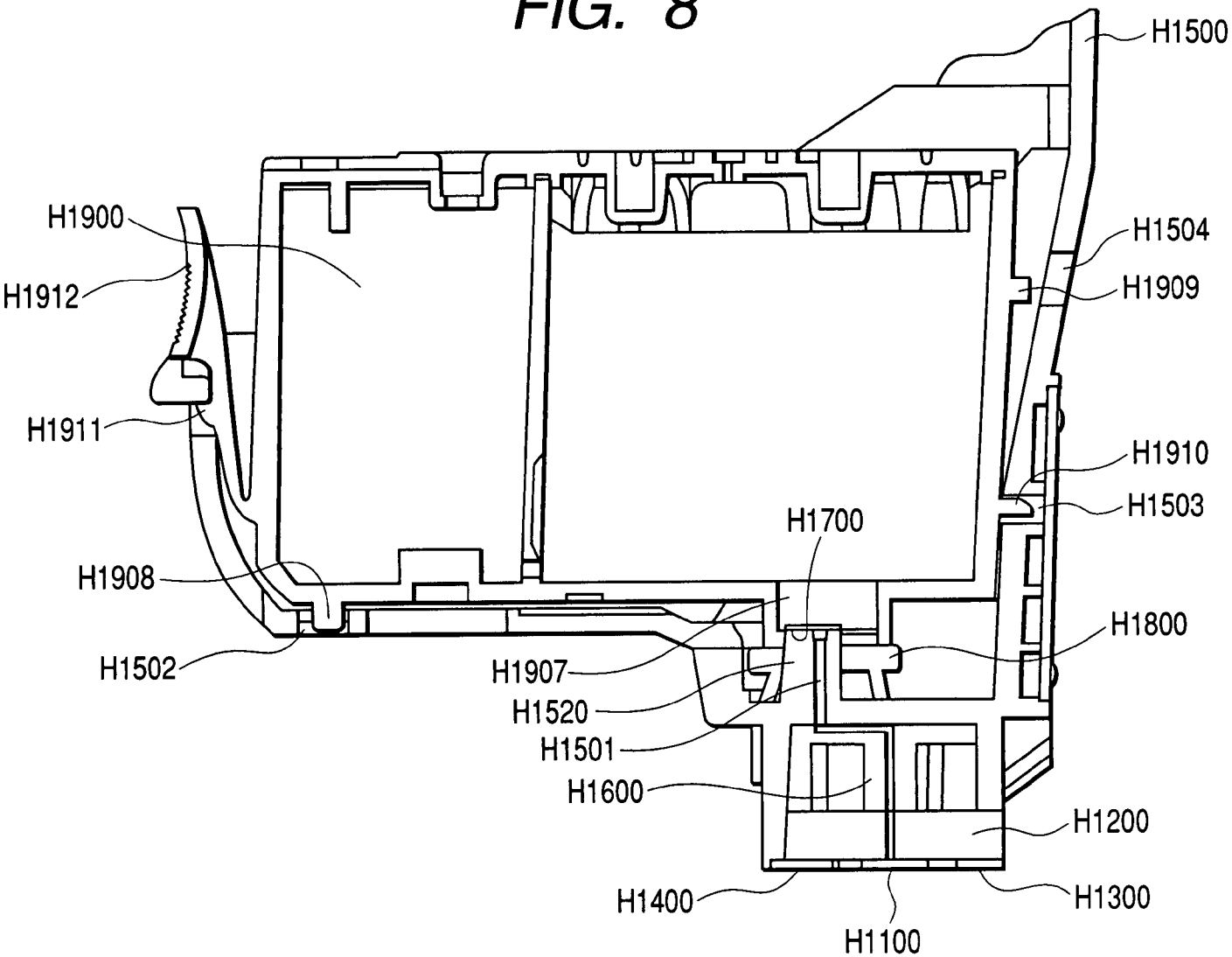
FIG. 8 is a cross-sectional view illustrating the recording head cartridge illustrated in FIG. 2, for example.

FIGS. 2 and 3 illustrate the operation for loading the ink tanks H1901, H1902, H1903 and H1904 in the recording head H1001 constituting the recording head cartridge H1000. The ink tanks H1901, H1902, H1903 and H1904 are filled with the above-mentioned color inks, respectively. Further, as illustrated in FIG. 8, the ink supply port H1907 for supplying ink in each ink tank to the recording head H1001 is formed in each tank H1900. For example, when the ink tank H1901. is loaded in the recording head H1001, the ink supply port H1907 of the ink tank H1901 is pressed against the filter H1700 provided in the joint portion H1520 of the recording head H1001. Black ink in the ink tank H1901 is hence supplied to the first recording element board H1100 from the ink supply port H1907 through the ink flow path H1501 in the recording head H1001 and the first plate H1200.

The ink is supplied to the bubbling chamber provided with the electrothermal converting element H1103 and the discharge port H1107, and the ink is discharged toward a recording paper of the recording medium by thermal energy imparted to the electrothermal converting element H1103. Image is thus recorded on the recording paper.

Denoted at H1502 is a tank positioning hole. Denoted at H1504 is a second hole. Denoted at H1908 is a tank positioning pin. Denoted at H1909 is a first claw. Denoted at H1911 is a third claw. Denoted at H1912 is a movable lever.

First Embodiment of the Present Invention

A first embodiment of the present invention will hereinafter be described.

(1) Coating of the First Sealing Resin 18

The coating method of the first sealing resin 18 will be described with reference to FIGS. 11 to 13. A tip needle portion of a syringe with the first sealing resin 18 injected therein is initially brought to a portion A of a recess portion 17*a*. The needle is then moved from the portion A of a recess portion 17*a* to its portion A' while the first sealing resin 18 is being discharged. Likewise, the needle is moved from a portion B of the recess portion 17*a* to its portion B' while the first sealing resin 18 is being discharged. The recess portion 17*a* is thus filled with the first sealing resin 18.

Figure 11:
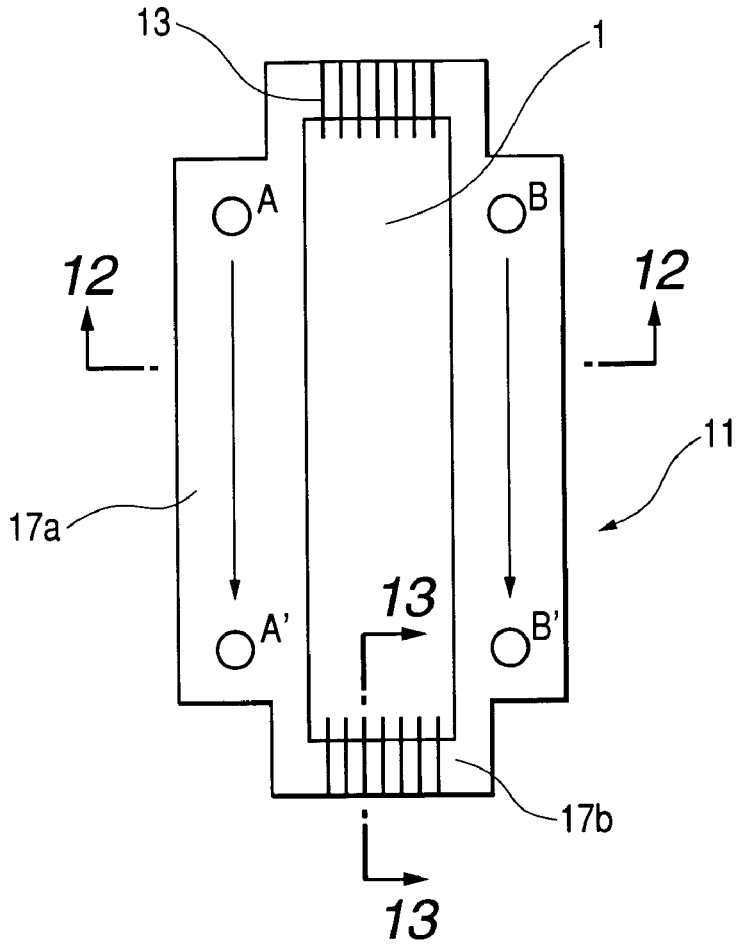
FIG. 11 is a view illustrating a coating method of first sealing resin in a first embodiment according to the present invention.

During such operation, since the first sealing resin 18 having a good fluidity is used, the first sealing resin 18 flows into and fills a recess portion 17*b* underneath the electrode leads 13 after filling the recess portion 17*a* (see FIG. 11).

Figure 12:
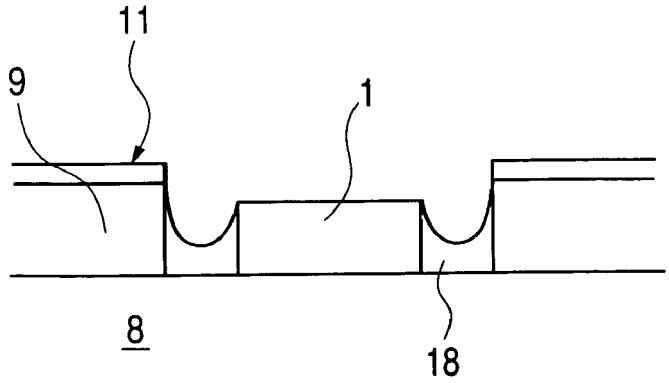
FIG. 12 is a cross-sectional view taken along the line 12—12 in FIG. 11 illustrating the first embodiment.
Figure 13:
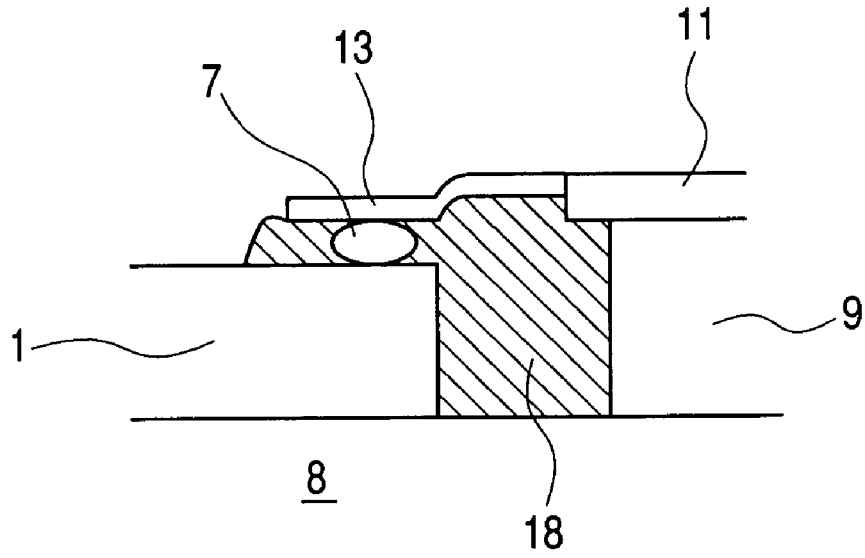
FIG. 13 is a cross-sectional view taken along the line 13—13 in FIG. 11 illustrating the first embodiment.

FIGS. 12 and 13 illustrate a condition established after the filling operation of the first sealing resin 18. FIG. 12 is a 12—12 cross-sectional view of FIG. 11 illustrating the condition established subsequent to the filling operation of the first sealing resin 18. The first sealing resin 18 fills the recess portion 17*a* formed by the element board 1, the support plate 9 and the support member 8, and seals connecting locations of the respective portions.

FIG. 13 is a 13—13 cross-sectional view of FIG. 11 illustrating the condition established subsequent to the filling operation of the first sealing resin 18. Since the first sealing resin 18 filling the recess portion 17*a* has a good fluidity, the first sealing resin 18 flows into and fills the recess portion 17*b* underneath the electrode leads. When the overall structure is heated during the above operation, the fluidity of the first sealing resin 18 can be further increased such that flowing and filling thereof can be achieved more smoothly.

Spaces underneath the electrode leads 13 and gaps between the electrodes 7 can be filled with the first sealing resin 18 due to its meniscus, and the electrical connecting portion can be sealed as illustrated in FIG. 13.

As the first thermosetting sealing resin 18, it is preferable to use a thermosetting sealant, such as thermosetting silicon-denatured epoxy resin produced by Nihon Rec Co., Ltd. (its trade name is NR200C), that still has resiliency after subjected to curing treatment, and has a good fluidity during its coating operation (this is required to fill the recess portions 17*a* and 17*b* therewith).

(2) Membrane Curing of the First Sealing Resin 18

Figure 17:
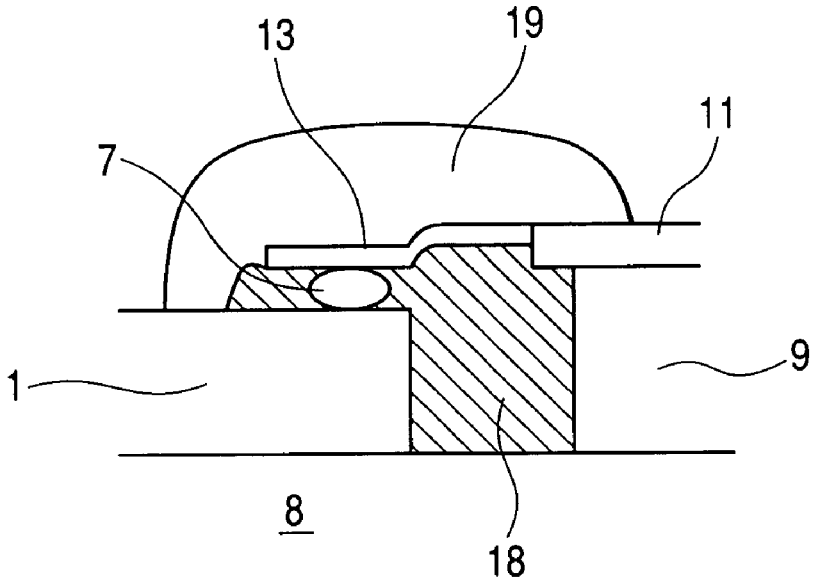
FIG. 17 is a view illustrating a sealing condition after overall second sealing resin is cured in the first embodiment.

The first sealing resin 18, with which recesses are filled, is then membrane-cured. The membrane-cured condition means a condition under which the surface of resin is cured (for example, a finger-touch dried condition under which the resin does not stick to the finger or the like even if touched thereby), and at the same time its inner portion is under a gel condition. More specific factors for achieving the membrane-cured condition are those three points as follows:

(a) Even when the second sealing resin is laid over the membrane-cured first sealing resin, no compatible layer is created at a boundary layer between the first sealing resin and the second sealing resin (see FIG. 17).

(b) Alternatively, the membrane-cured first sealing resin loses fluidity. Thereby, when the second sealing resin is laid, the first sealing resin (including the compatible layer) loses fluidity due to its membrane curing even if the compatible layer is partially created between the first sealing resin and the second sealing resin. Further, when the second sealing resin is laid so as to completely cover the compatible layer, the second sealing resin prevents the compatible layer from communicating the electrode lead and the electrical connecting portion to the outside, and continues to maintain the sealing condition. Electrical reliability of the head can hence be improved (see FIG. 18).

(c) More preferably, a condition, under which after the first sealing resin is membrane-cured, its retraction dows not occur between the electrode leads, is satisfied, in addition to the above conditions of (a) or (b).

Figure 20:
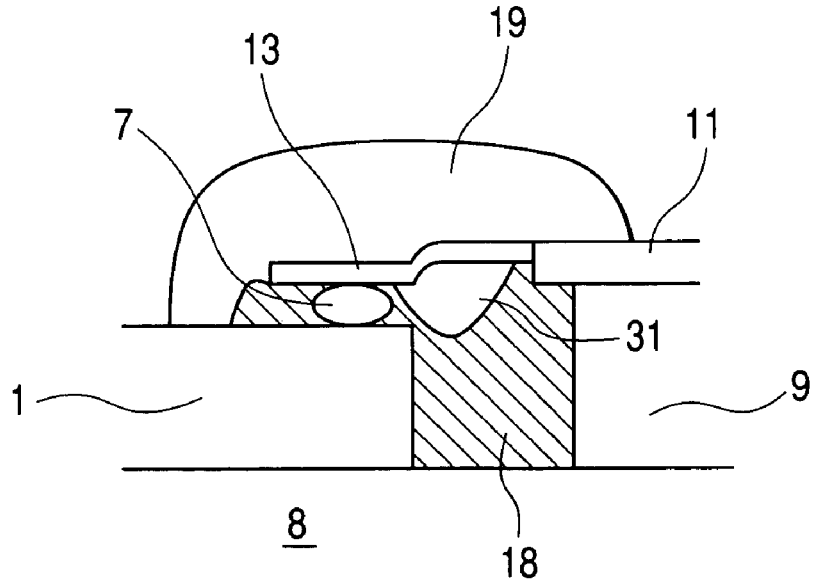
FIG. 20 is a view illustrating an air void in a boundary portion between first and second sealing resins in a conventional example.

If retraction due to curing and contraction of the resin appears in portions such as portions between the electrode leads, the second sealing resin having a high viscosity and serving as the dam agent cannot enter the retraction portion. Accordingly, the air void is likely to occur in the electrode lead portion and the electrical connecting portion, and lower the sealing condition. Further, the air void expands and erupts during the curing process of the sealing resin, thereby making holes in the second sealing resin and damaging the sealing condition (see FIG. 20).

Specifically, for example, in the case where the thermosetting silicon-denatured epoxy resin produced by Nihon Rec Co., Ltd. (its trade name is NR200C) is used as the first sealing resin 18 and the thermosetting epoxy resin produced by Matsushita Electric Works, Ltd. (its trade name is CV5420D) is used as the second sealing resin 19, the curing condition of the first sealing resin is as follows.

With NR200C used as the first sealing resin, curing treatment at 100° C. is needed for one (1) hour (this is performed for venting gas at the time of curing, and its purpose differs from that for preventing occurrence of the compatible layer), and complete curing treatment at 150° C. is needed for 3.5 hours.

In this embodiment, after the first resin is laid, the first resin is maintained at 100° C. for three (3) hours to be membrane-cured.

When the first sealing resin is membrane-cured, a membrane is formed on its surface and the following condition is established. Under this condition, even when another sealing resin, which is CV5420D of the second sealing resin in this embodiment, is applied on that surface, no compatible layer occurs at the boundary layer.

Further, NR200C under the membrane-cured condition is further cured with the lapse of time, and its viscosity considerably increases even in its inner portion. Thus, even in a portion other than the membrane, its fluidity reaches such a low level that is hardly confirmed by an experiment of FIG. 14 for identifying the fluidity.

Figure 14:
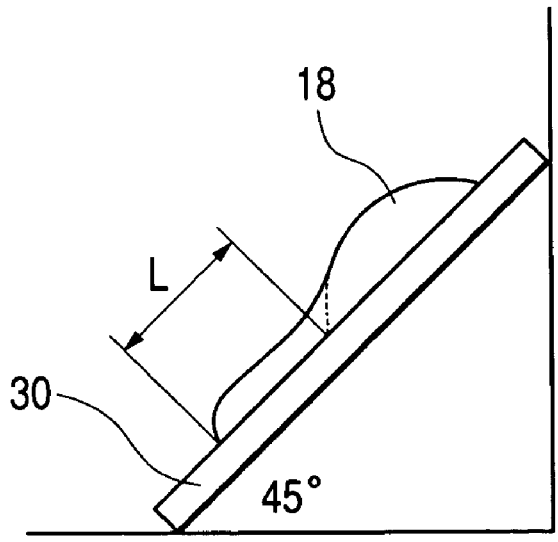
FIG. 14 is a view illustrating a method of experimenting fluidity of sealing resin.

The cured condition at no-fluidity level will be described with reference to the fluidity identifying experiment of FIG. 14.

Liquid to be tested is applied on a glass plate 30. The glass plate 30 is tilted at 45 degrees, and the distance (L) of flow of the liquid is measured after a predetermined time. Its fluidity is thus identified.

The no-fluidity level means a condition under which there is almost no liquid flow distance in the fluidity identifying experiment, for example, though not a completely-cured condition.

Under such no-fluidity cured condition, when after NR200C of the first sealing resin 18 is membrane-cured to create the membrane on its surface, CV5420D of the second sealing resin is laid on this surface, it is possible to cover the compatible layer with the second sealing resin 19 even if a portion of the membrane of the first sealing resin 18 is broken by pressure applied on the superficial membrane of the first resin and resultantly the compatible layer is partially generated. Accordingly, the sealing condition of the electrical connecting portion can be maintained against its outside (see FIG. 18).

With NR200C of the first sealing resin, an inner portion of the resin layer is further cured and the overall resin layer begins to be solidified if its curing treatment at 150° C. is executed for a period of about five (5) hours. Accordingly, its retraction due to curing and contraction is likely to occur.

Therefore, when the second sealing resin is laid, an air layer is liable to appear at the boundary portion between the first and second sealing resins, at which the electrical connecting portion is present, and the sealing characteristic decreases.

If the curing period is three (3) hours, the inner portion is still in the gel condition though the cured membrane exists on the surface. Accordingly, no retraction due to curing and contraction caused by the solidification appears. Accordingly, the period of heat treatment for membrane curing of NR200C of the first sealing resin is suitably about three (3) hours.

(3) Coating of the Second Sealing Resin 19

Figure 15:
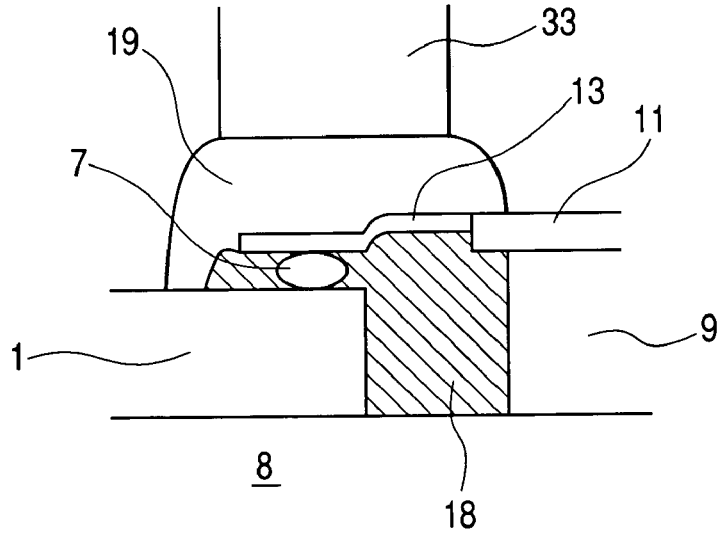
FIG. 15 is a view illustrating coating of second sealing resin in the first embodiment.
Figure 16:
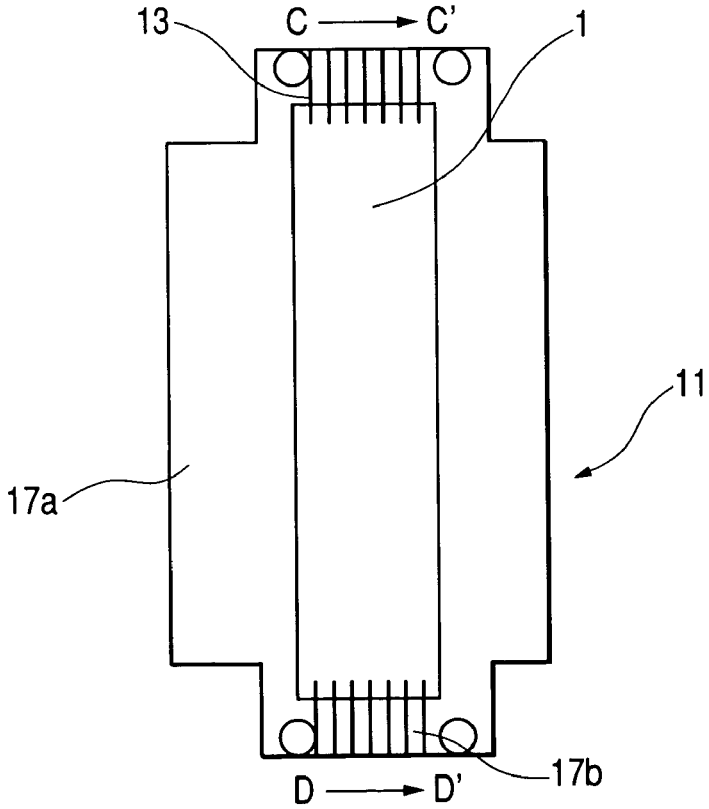
FIG. 16 is a view illustrating a coating method of second sealing resin in the first embodiment.

The coating method of the second sealing resin 19 will be described with reference to FIGS. 15 to 17. A tip needle portion of a syringe with the second sealing resin 19 injected therein is initially brought to a portion C above the electrical lead portion 13. The needle 33 is then moved from the portion C to a portion C' while the second sealing resin 19 is being discharged. Likewise, the needle 33 is moved from a portion D to a portion D' while the second sealing resin 19 is being discharged. The second sealing resin 19 is laid so as to fully cover the electrical connecting portion of the lead electrode 13 and the electrode 7.

Important points of applying the second sealing resin 19 will be described with reference to FIGS. 17 to 19.

(a) The electrode lead 13 and the electrical connecting portion 7 are fully and widely covered to completely seal the electrical connecting portion (see FIG. 17).

(b) The second sealing resin 19 is laid such that the cured membrane of the first sealing resin 18 cannot be broken during the coating operation. The surface of the first sealing resin is cured in the membrane form by membrane curing, but the membrane is liable to be broken if the second sealing resin is laid too vigorously. In such a case, the compatible layer 29 can be extruded outside (i.e., an extrusion 32 of the compatible layer 29 is likely to appear) (see FIG. 19).

Figure 18:
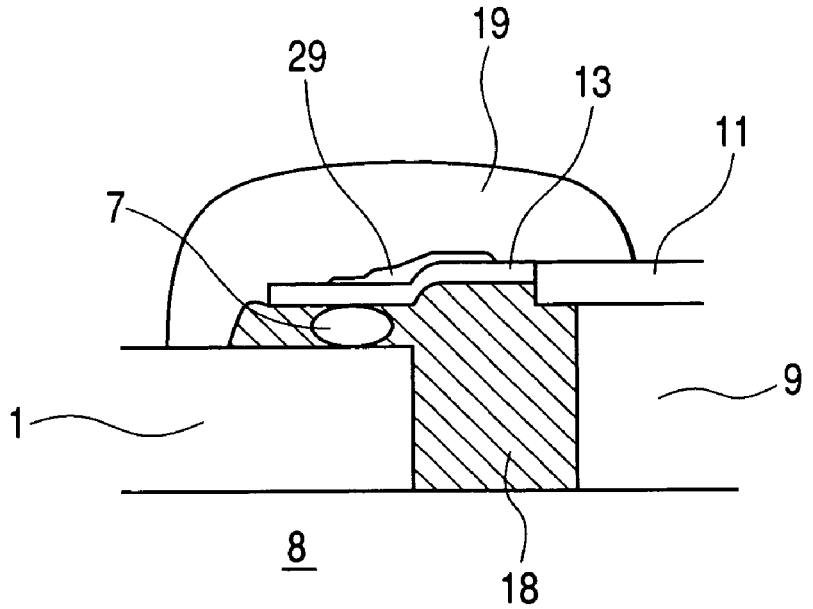
FIG. 18 is a view illustrating a sealing condition after overall second sealing resin is cured in the first embodiment.
Figure 19:
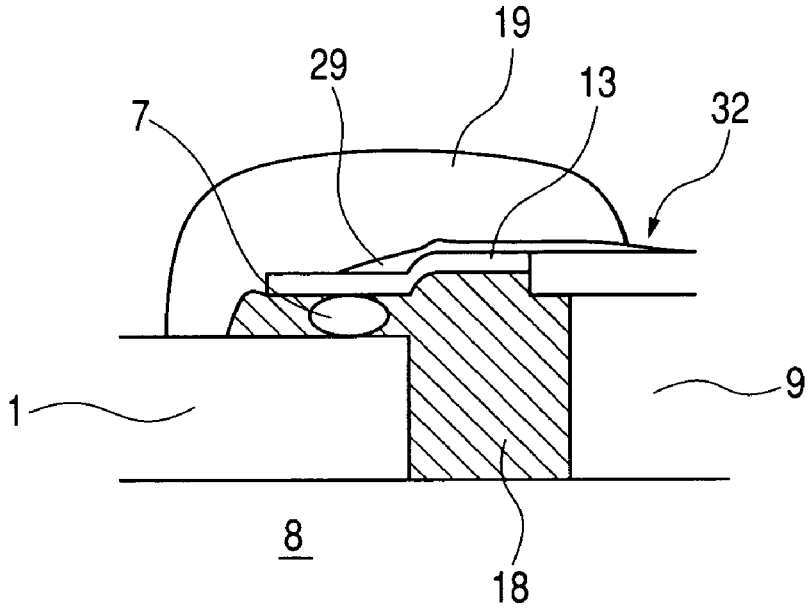
FIG. 19 is a view illustrating extrusion of a compatible layer in a conventional example.

(c) The second sealing resin is laid so as to fully cover the first sealing resin (see FIG. 18). Even if the first sealing resin layer is partially broken, the coating is executed so as to fully cover the broken portion with second sealing resin.

Thereby, even if the first sealing resin layer is partially broken and the compatible layer 29 appears as illustrated in FIG. 18 during the coating operation of the second sealing resin, the compatible layer 29 is prevented from communicating to the outside due to the fact that the first sealing resin is under the gel condition and loses fluidity, or the fact that the second sealing resin is laid so as to fully cover the fluidity-lost first sealing resin (the compatible layer). Therefore, the sealing condition of the electrical connecting portion and the electrode lead against the outside is maintained.

Specifically, it is preferable to use a needle having a large diameter, as the needle installed to the tip portion of the syringe for applying the second sealing resin, such that the coating pressure can be reduced and the coating rate can be lowered.

In other words, when the needle diameter is large, the coating pressure tends to decrease and it becomes difficult to break the first sealing resin layer (including the compatible layer). Further, even if the first sealing resin is partially broken, the fluidity-lost first sealing resin does not extrude from a region covered by the second sealing resin to the outside. Furthermore, when the needle diameter is large, the coating width of the second sealing resin is widened such that the first sealing resin can be readily covered therewith.

(4) Complete Curing

The first and second sealing resins 18 and 19 laid by the above-discussed steps (1) to (3) are completely cured at the same time.

With the thermosetting silicon-denatured epoxy resin (NR200C) of the first sealing resin 18, and the thermosetting epoxy resin (CV5420D) of the second sealing resin 19, their conditions for complete curing are the same, and it is hence possible to achieve simultaneous complete curing under the same condition. Specifically, their complete curing can be accomplished by heating them at 150° C. for three (3) hours.

In the above-discussed method, only one complete curing step is needed, and its productivity efficiency can hence be improved, as compared with a step in which after the first sealing resin 18 is completely cured, the second sealing resin 19 is laid thereon and their complete curing is then performed.

The thus-constructed invention can provide a manufacturing method of a liquid jet recording head in which even when a sufficient amount of sealing resin is laid such that the recess portion around the recording element board can be filled therewith, the recording element board is not broken by curing and contraction of the sealing resin, and the electrical connecting portion between the recording element board and the flexible film wiring board can be protected against external forces such as wiping force. Further, no compatible layer appears at the boundary portion between the first and second sealing resins present in the electrical connecting portion, and a strong bonded state can be achieved at their interface. Accordingly, sealing condition against ink and the like can be improved, and electrical reliability of the head can be enhanced.

Further, even when the compatible layer is partially created between the first sealing resin and the second sealing resin, the compatible layer has no fluidity, and further the second sealing resin can completely cover the compatible layer, and can prevent the compatible layer from communicating to the outside to protect the sealing portion against attack of ink. Accordingly, the compatible layer between the first sealing resin and the second sealing resin does not communicate the electrode lead and the electrical connecting portion to the outside, and the sealing portion continues to maintain the sealing condition. Electrical reliability of the head can hence be improved.

Further, in the above-discussed sealing process for obtaining the reliable sealing condition, the first sealing resin and the second sealing resin undergo simultaneous complete curing, and therefore the sealing process time can be shortened and its productivity efficiency can be enhanced.

Second Embodiment of the Present Invention

A second embodiment of the present invention will hereinafter be described. The first sealing resin 18, and the second sealing resin 19 used in the second embodiment are the same as those used in the first embodiment.

(1) Coating of the First Sealing Resin 18

The coating method of the first sealing resin 18 will be described with reference to FIGS. 21 to 23. A tip needle portion of a syringe with the first sealing resin 18 injected therein is initially brought to a portion A of a recess portion 17*a*. The needle is then moved from the portion A of the recess portion 17*a* to its portion A' while the first sealing resin 18 is being discharged. Likewise, the needle is moved from a portion B of the recess portion 17*a* to its portion B' while the first sealing resin 18 is being discharged. The recess portion 17*a* is thus filled with the first sealing resin 18 (see FIG. 21).

During such operation, since the first sealing resin 18 having a good fluidity is used, the first sealing resin 18 flows into and fills a recess portion 17*b* underneath the electrode leads 13 after the recess portion 17*a* is filled therewith(see FIG. 11), such that the recess portion 17*b*, the electrode leads 13 and the electrodes 7 can be fully covered therewith.

Figure 23:
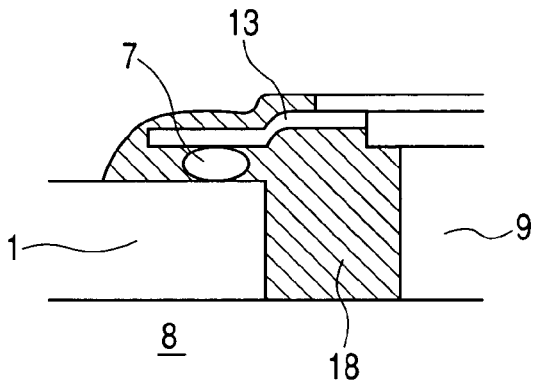
FIG. 23 is a cross-sectional view taken along the line 23—23 in FIG. 21 illustrating the second embodiment.

In the second embodiment, it is important that the first sealing resin 18 is laid such that the electrode leads 13 and the electrodes 7 can be fully covered therewith (see FIG. 23). The following methods can be utilized to attain such purpose.

(a) In FIG. 23, a timer is set to determine a stop timing under a condition under which the first sealing resin 18 is being applied to the A, A', B, and B' portions, and these A, A', B, and B' portions are filled with such a sufficient amount of the first sealing resin 18 as can fully cover the electrodes 7 and the electrode leads 13.

Figure 25:
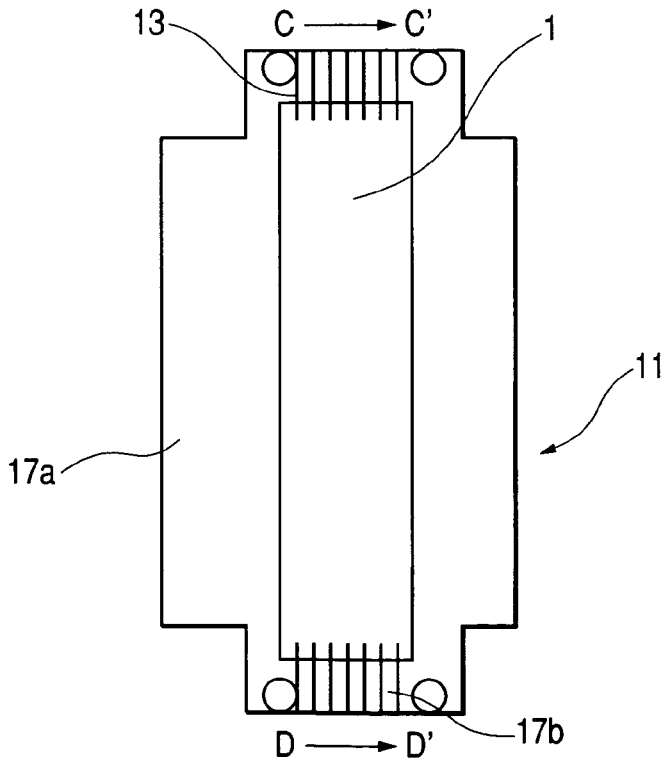
FIG. 25 is a view illustrating a coating method of second sealing resin in the second embodiment.

(b) In the event that the electrodes 7 and the electrode leads 13 cannot be covered by the above method (a), it is possible to directly apply the first sealing resin 18 from above to locations from a portion C to a portion C', and from a portion D to a portion D' illustrated in FIG. 25, though the tact of the coating step is extended.

(c) Further, when surface treatment (for example, UV ozone treatment) for improving wettability is beforehand executed on the electrodes 7 and the electrode leads 13, electrodes 7 and the electrode leads 13 can be readily covered with the first sealing resin 18.

Figure 21:
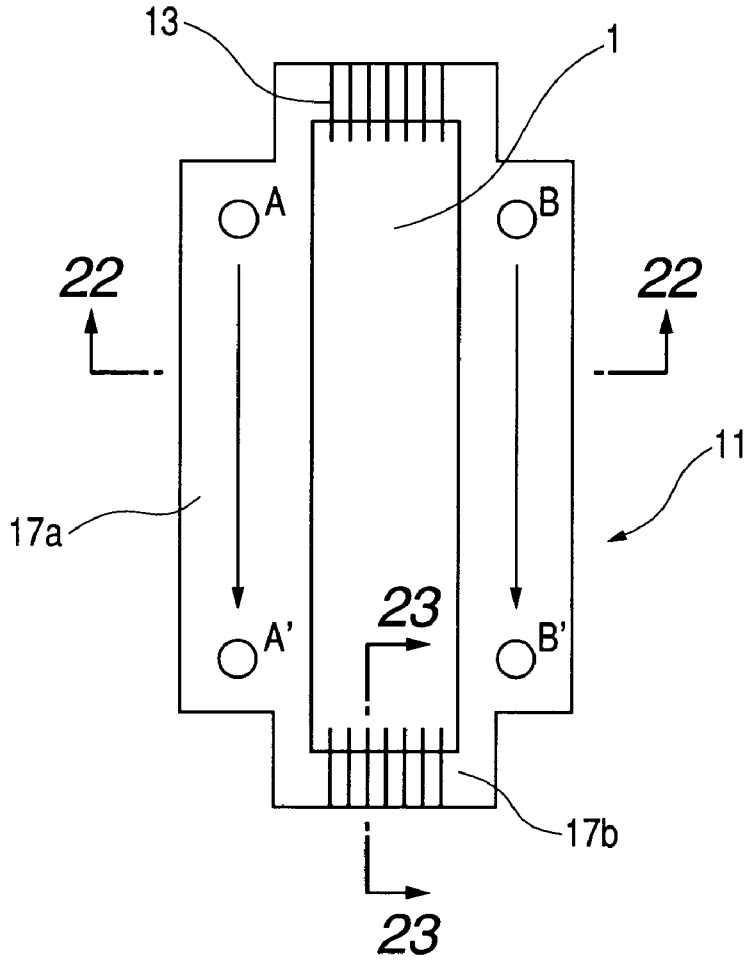
FIG. 21 is a view illustrating a coating method of first sealing resin in a second embodiment according to the present invention.
Figure 22:
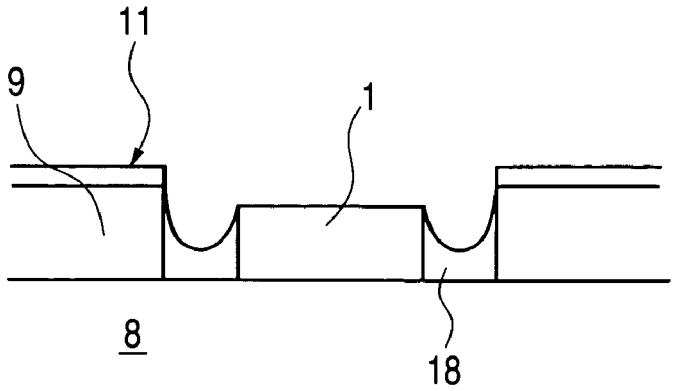
FIG. 22 is a cross-sectional view taken along the line 22—22 in FIG. 21 illustrating the second embodiment.

FIGS. 22 and 23 illustrate a condition established after the filling operation of the first sealing resin 18. FIG. 22 is an 22-22 cross-sectional view of FIG. 21 illustrating the condition established subsequent to the filling operation of the first sealing resin 18. The recess portion 17*a* formed by the element board 1, the support plate 9 and the support member 8 is filled with the first sealing resin 18, and connecting locations of the respective portions are sealed.

FIG. 23 is a 23—23 cross-sectional view of FIG. 21 illustrating the condition established subsequent to the filling operation of the first sealing resin 18. Since the first sealing resin 18 laid in the recess portion 17*a* has a good fluidity, the first sealing resin 18 flows into and fills the recess portion 17*b* underneath the electrode leads, and fully covers the recess portion 17*b*, the electrode leads 13, and the electrodes 7. When the overall structure is heated during the above operation, the fluidity of the first sealing resin 18 is further increased such that its better flowing and filling can be achieved.

(2) Membrane Curing of the First Sealing Resin 18

The first sealing resin 18 laid in recesses is then membrane-cured. The membrane-cured condition is the same as that described in the first embodiment, but the membrane-cured condition of the second embodiment can be described as follows:

(a) The first sealing resin 18 is membrane-cured, and its viscosity is raised such that the second sealing resin 19 does not sink in the first sealing resin 18 and does not reach the electrical connecting portion during the applying operation of the second sealing resin 19. In other words, after the first sealing resin 18 and the second sealing resin 19 are fully cured, the first resin 18 exists on the electrical connecting portion (electrodes 7 and electrode leads 13), and the second resin 19 exists thereon. The membrane-cured condition of the second embodiment can establish such construction.

(b) After the first sealing resin 18 is membrane-cured, retraction of the first sealing resin 18 does not occur between the electrode leads.

If retraction due to curing and contraction appears in the first sealing resin 18 between the electrode leads and so forth, the second sealing resin 19 having a high viscosity and serving as the dam agent cannot enter the retraction portion. Accordingly, an air void 31 is likely to occur in the electrode lead portion and the electrical connecting portion, and lower the sealing condition. Further, the air void 31 expands and erupts during the curing process of the sealing resin, thereby making holes in the second sealing resin 19 and damaging the sealing condition (see FIG. 20).

When the following two conditions are achieved, reliability of the sealing condition can be further increased.

In other words, in order that no compatible layer appears between the first sealing resin 18 covering the electrode leads 13 and the electrodes 7, and the second sealing resin 19, and that even when the compatible layer appears, communication between this compatible layer and the outside of the second sealing resin 19 can be prevented, the electrode leads 13 and the electrodes 7 are fully covered with the first and second sealing resins 18 and 19, thereby establishing the complete sealing condition.

Figure 26:
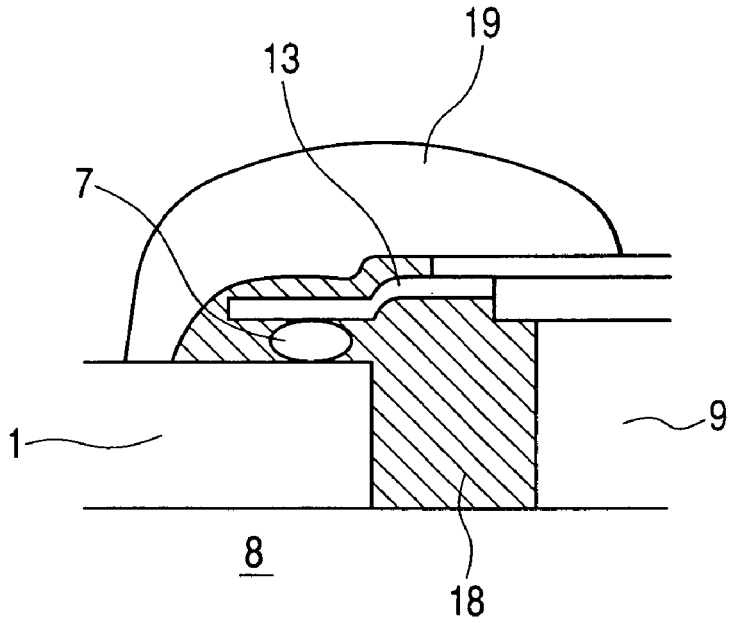
FIG. 26 is a view illustrating a sealing condition after overall second sealing resin is cured in the second embodiment.

(a) Even when the second sealing resin 19 is laid over the membrane-cured first sealing resin 18, no compatible layer is created at the boundary layer between the first sealing resin 18 and the second sealing resin 19 (see FIG. 26).

(b) Alternatively, the membrane-cured first sealing resin 18 loses fluidity. Thereby, when the second sealing resin 19 is laid, the first sealing resin 18 (likewise the compatible layer itself) loses fluidity due to its membrane curing even if the compatible layer is partially created. Further, the second sealing resin 19 is laid so as to completely cover the compatible layer. Accordingly, the compatible layer between the first sealing resin 18 and the second sealing resin 19 is prevented from communicating to the outside. Hence, the sealing condition is maintained, and electrical reliability of the head can be improved.

When the first sealing resin 18 and the second sealing resin 19, which are the same as those used in the first embodiment, are used in the second embodiment, the membrane-curing condition for the first sealing resin 18 is as follows.

After the first sealing resin 18 is laid, its membrane curing as discussed in the first embodiment is performed by heating it at 100° C. for about three (3) hours. The viscosity of the membrane-cured first sealing resin 18 is raised, and hence, even when the second sealing resin 19 is laid on the membrane-cured first sealing resin 18, the second sealing resin 19 does not sink into the first sealing resin 18. In other words, after the complete curing operation, the first sealing resin 18 exists on the electrical connecting portion, and the second sealing resin 19 exists thereon. In this state, since the electrical leads 13 and the electrodes 7 are completely covered with the second sealing resin 19, the electrical leads 13 and the electrodes 7 subsequent to the complete curing operation are basically sealed by the second sealing resin 19. Accordingly, even when the compatible layer 29 exists at the interface between the first sealing resin 18 and the second sealing resin 19, there is no problem with electrical reliability of the head (see FIG. 27).

Furthermore, when heat treatment for the membrane curing is performed for three (3) hours, no compatible layer appears between the first and second sealing resins 18 and 19 covering both the electrical leads 13 and the electrodes 7. In addition, even when the compatible layer 29 appears, communication between this compatible layer and the outside of the second sealing resin 19 is prevented, and hence the electrode leads 13 and the electrodes 7 are fully covered with the first and second sealing resins 18 and 19. It is thus possible to establish further complete sealing condition (see FIG. 27).

Specifically, when the first sealing resin 18 is heated at 100° C. for three (3) hours to be membrane-cured, a membrane is formed on its surface. Under this condition, even when another sealing resin, which is CV5420D of the second sealing resin 19 in this embodiment, is applied on that surface, no compatible layer 29 occurs at the boundary layer.

Further, the first sealing resin 18 under the membrane-cured condition is further cured with the lapse of time, its fluidity considerably lowers even in its inner portion. Thus, even in a portion other than the membrane, its fluidity reaches such a low level that is hardly confirmed by the experiment of FIG. 14 for identifying the fluidity.

Under the above-discussed no-fluidity cured condition, it is possible to cover the compatible layer 29 with the second sealing resin 19 even if a portion of the membrane of the first sealing resin 18 is broken and the compatible layer is partially generated. Consequently, the sealing condition of the electrical connecting portion can be maintained against its outside.

In NR200C of the first sealing resin 18, the resin layer is further cured and the overall resin layer begins to be solidified if its heat treatment for the membrane curing is performed for a period of about five (5) hours. Accordingly, its retraction due to curing and contraction is likely to occur. Therefore, when the second sealing resin 19 is laid on the first sealing resin 18, an air layer is liable to appear at the boundary portion between the first and second sealing resins, at which the electrical connecting portion is present, and the sealing characteristic decreases (see FIG. 20).

Therefore, the period of heat treatment for membrane curing of NR200C of the first sealing resin 18 is suitably about three (3) hours.

(3) Coating of the Second Sealing Resin 19

The coating method of the second sealing resin 19 will be described with reference to FIGS. 24 to 26.

A tip needle portion 33 of a syringe with the second sealing resin 19 injected therein is initially brought to a portion C above the electrical lead portion 13. The needle 33 is then moved from the portion C to a portion C' while the second sealing resin 19 is being discharged from the needle 33. Likewise, the needle 33 is moved from a portion D to a portion D' while the second sealing resin 19 is being discharged from the needle 33. The second sealing resin 19 is laid so as to fully cover the electrical connecting portion of the lead electrode 13 and the electrode 7.

Basically, the following points (a) and (b) are important. The viscosity of NR200C of the first sealing resin 18 is raised by the membrane curing, but if the second sealing resin 19 is applied too vigorously from above the first sealing resin 18, the second sealing resin 19 is liable to sink in the first sealing resin 18 due to its applying pressure. Accordingly, no compatible layer 29 is caused to appear at the interface between the first sealing resin 18 and the second sealing resin 19. Alternatively, even when the compatible layer 29 partially occurs, the compatible layer 29 is caused not to extrude toward the outside of the second sealing resin 19. Thereby, the lead portion and the electrode are completely covered with the first sealing resin 18 and the second sealing resin 19. The following points (c) and (d) are needed to achieve a more complete sealing condition.

(a) The electrode lead 13 and the electrode 7 are fully and widely covered to completely seal the electrical connecting portion (see FIG. 26).

(b) The second sealing resin 19 is laid such that it cannot be pushed into the first sealing resin 18 during the coating operation of the first sealing resin 18 with the second sealing resin 19.

(c) The second sealing resin 19 is laid such that the cured membrane of the first sealing resin 18 cannot be broken during the coating operation of the first sealing resin 18 with the second sealing resin 19. The surface of the first sealing resin 18 is cured in the membrane form by the membrane curing, but the membrane is liable to be broken if the second sealing resin 19 is laid too vigorously. The compatible layer 29 is thus occurs (see FIG. 19).

Figure 28:
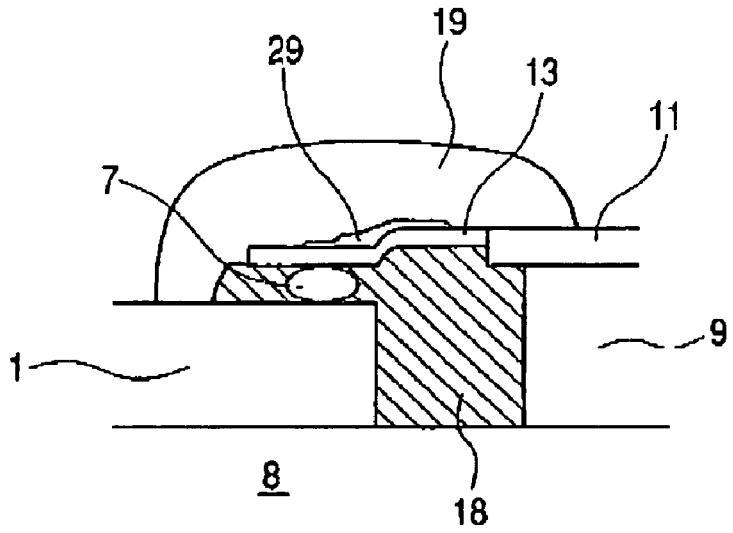
FIG. 28 is a view illustrating a sealing condition after overall second sealing resin is cured in the second embodiment.
Figure 29A:
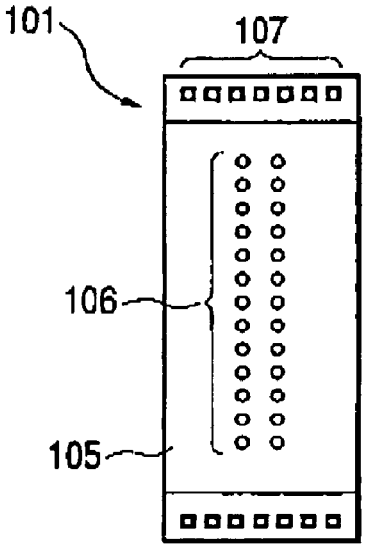
FIG. 29A (PRIOR ART)
FIGS. 29A, 29B and 29C are views illustrating a conventional recording element board in which general electrothermal converting elements are arranged and which achieves a function of discharging recording liquid.
Figure 29B:
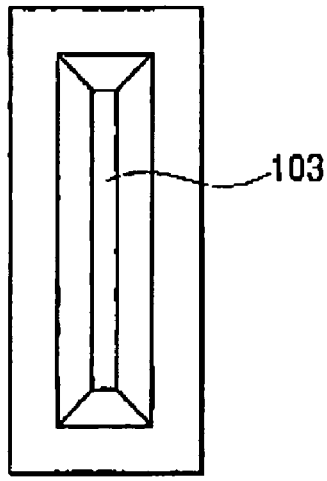
FIG. 29B (PRIOR ART)
Figure 29C:
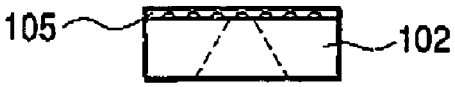
FIG. 29C (PRIOR ART)
Figure 30:
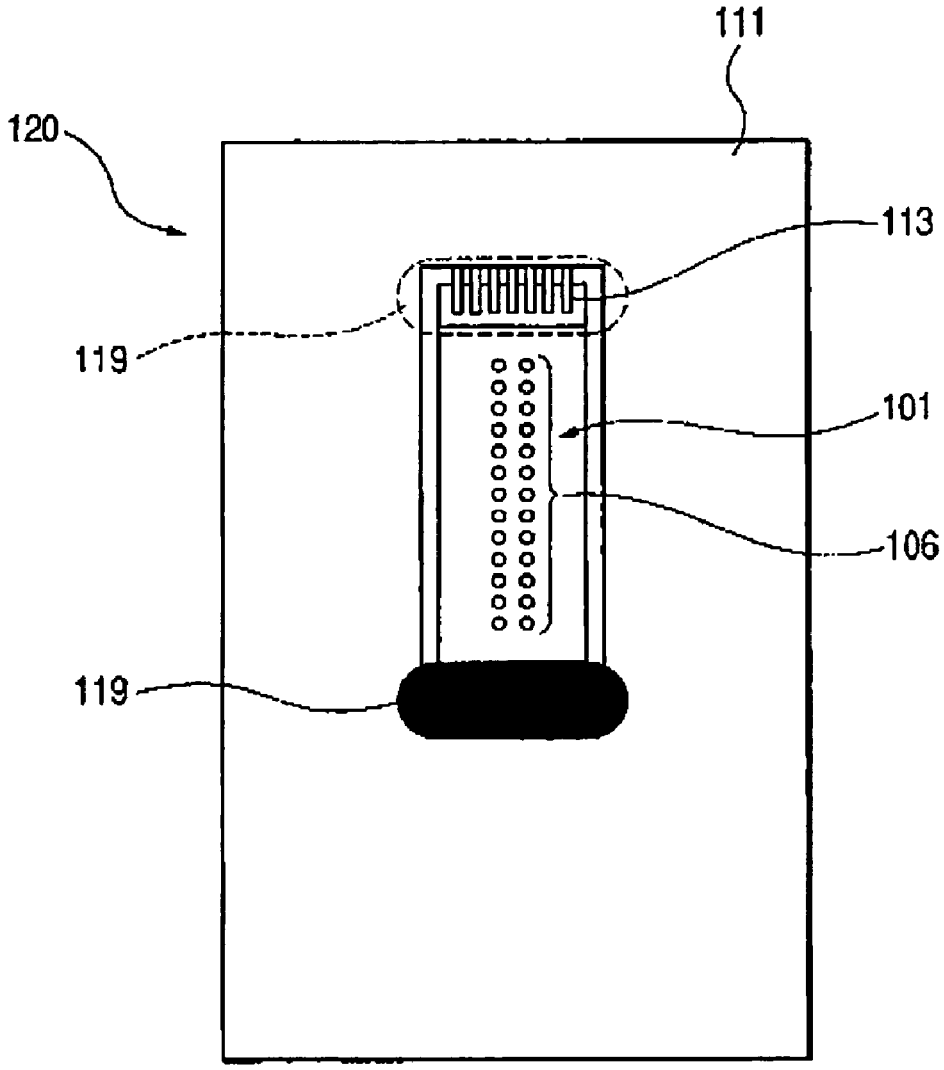
FIG. 30 (PRIOR ART)
FIG. 30 is a view illustrating a state in which the recording element unit illustrated in FIG. 29 is connected to a wiring board.
Figure 31A:
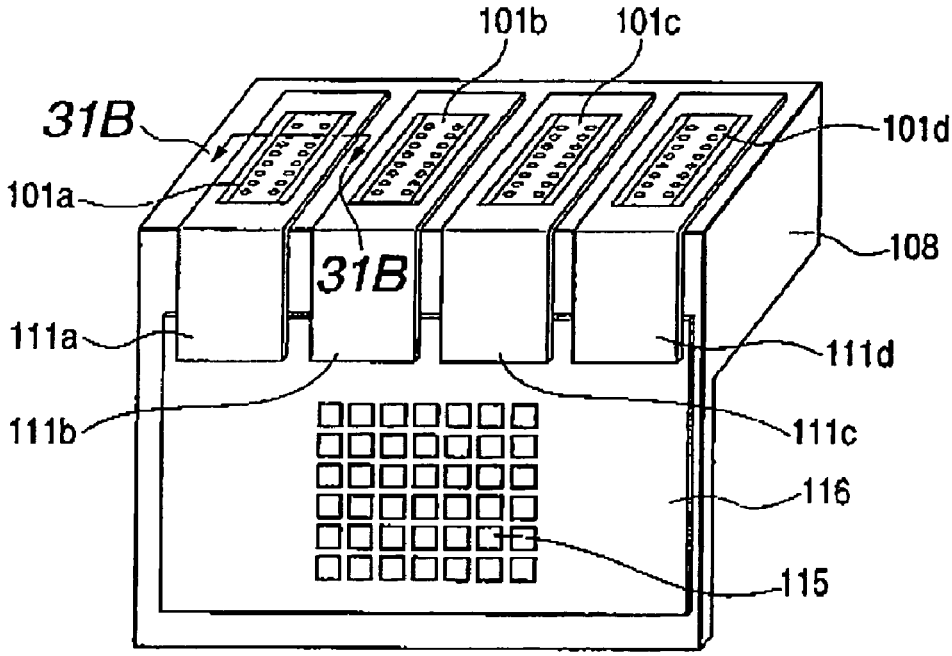
FIG. 31A (PRIOR ART)
FIGS. 31A and 31B are views illustrating a structural example of a conventional liquid jet recording head equipped with the recording element unit illustrated in FIG. 30.
Figure 31B:
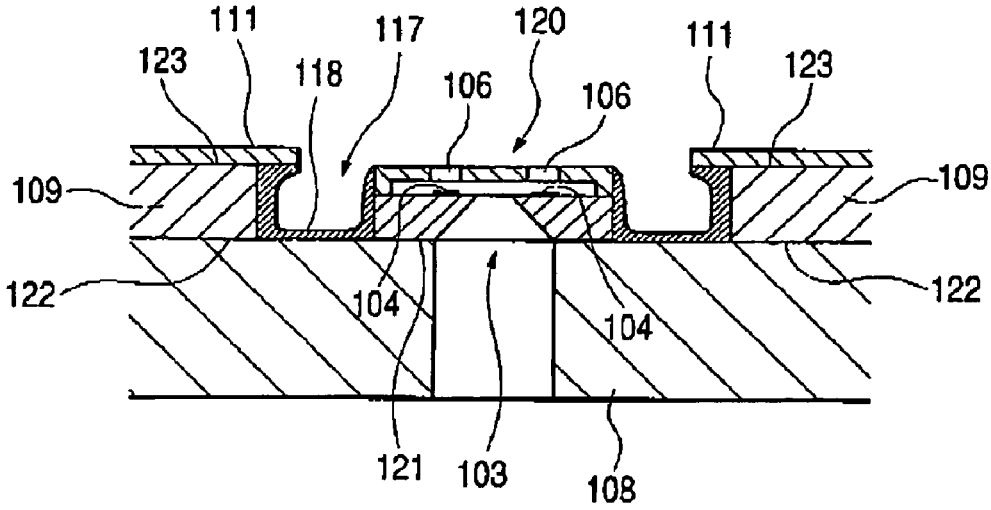
FIG. 31B (PRIOR ART)

(d) The second sealing resin 19 is laid so as to cover the first sealing resin 18 (see FIG. 28). Even if the first sealing resin layer 18 is partially broken, the coating is executed so as to fully cover the broken portion.

Figure 27:
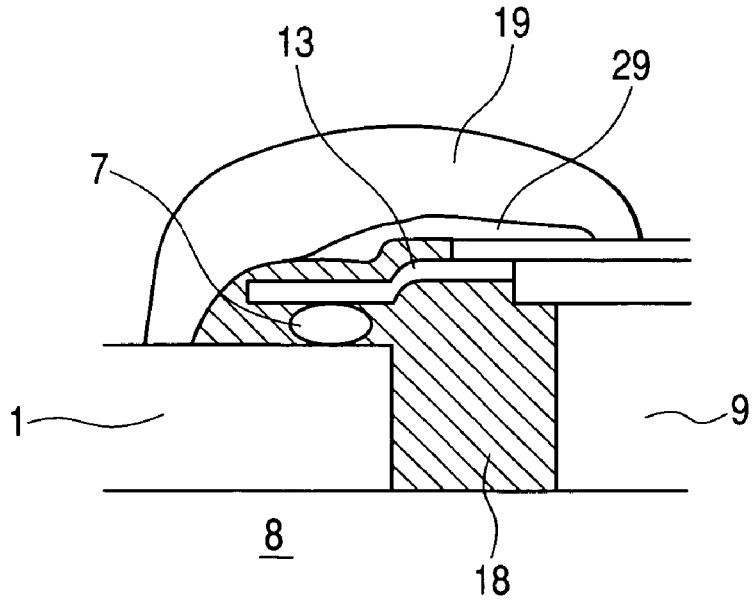
FIG. 27 is a view illustrating a sealing condition after overall second sealing resin is cured in the second embodiment.

Thereby, even if the membrane of the first sealing resin layer 18 is partially broken and the compatible layer 29 appears as illustrated in FIG. 27 during the coating operation of the second sealing resin 19, the compatible layer 29 is prevented from extruding through the cover of the second sealing resin 19 due to the fact that the first sealing resin 18 loses fluidity, or the fact that the second sealing resin 19 is laid so as to fully cover the fluidity-lost first sealing resin 18 (including the compatible layer 29). Therefore, the sealing condition against the outside is maintained.

Figure 24:
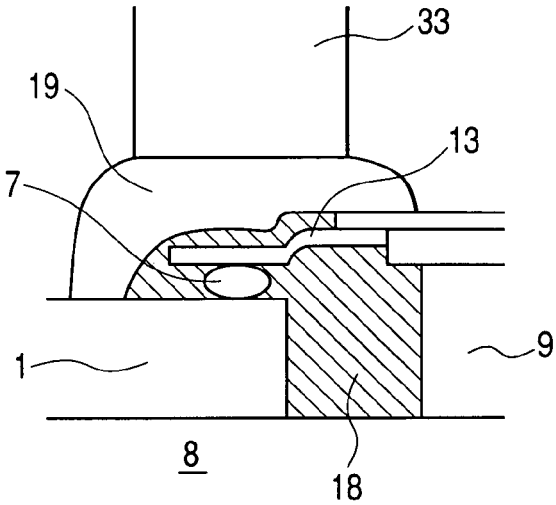
FIG. 24 is a view illustrating coating of second sealing resin in the second embodiment.

Specifically, it is preferable to use a needle 33 having a large diameter, as the needle installed to the tip portion of the syringe for applying the second sealing resin 19, such that the coating pressure can be reduced and the coating rate can be lowered (see FIG. 24).

In other words, when the diameter of the needle 33 is large, the coating pressure tends to decrease, and hence when the second sealing resin 19 is laid on the first sealing resin 18, the second sealing resin 19 does not sink in the first sealing resin 18. After complete curing, the electrode lead and the electrode can be covered with the first sealing resin 18. Further, it becomes difficult to break the membrane created on the first sealing resin layer 18 (including the compatible layer 29). Furthermore, even if the membrane is partially broken, the fluidity-lost first sealing resin 18 is not extruded through the cover of the second sealing resin 19 to the outside. Furthermore, when the diameter of the needle 33 is increased, the coating width of the second sealing resin 19 during the coating operation is widened such that the first sealing resin 18 can be readily covered therewith.

Similarly to the first embodiment, the second sealing resin 19 is required to effect protection from external forces such as wiping force, and cover the uneven electrical connecting portion under a smooth condition such that the wiper can be prevented from being damaged during the wiping operation, and therefore epoxy resin, especially dam agent (which is resin agent capable of being firm after cured and maintaining the cured-shape subsequent to the coating) is most suitable.

(4) Complete Curing

The first sealing resin 18 and the second sealing resin 19 laid by the above-discussed steps (1) to (3) are completely cured at the same time, similarly to the first embodiment. The curing method is the same as that described in the first embodiment.

As described in the following, according to the above-discussed embodiments, there can be provided a manufacturing method of a liquid jet recording head in which even when a sufficient amount of sealing resin is laid to fill the recess portion around the recording element board, the recording element board is not broken by curing and contraction of the sealing resin, and the electrical connecting portion between the recording element board and the flexible film wiring board can be protected against external forces such as wiping force.

Further, there can be provided a manufacturing method of a liquid jet recording head in which no compatible layer appears at the boundary portion between the first and second sealing resins present in the electrical connecting portion, and a strong bonded state can be achieved at their interface, so that the sealing condition against ink and the like can be improved, and electrical reliability of the head can be enhanced.

Further, there can be provided a manufacturing method of a liquid jet recording head in which even if the first sealing resin is partially broken and the compatible layer is created between the first sealing resin and the second sealing resin, the second sealing resin completely covers the compatible layer, and prevents the compatible layer from communicating to the outside to protect the head against attack of ink. Accordingly, the compatible layer between the first sealing resin and the second sealing resin does not communicate the electrode lead and the electrical connecting portion to the outside, and the head continues to maintain the sealing condition. Electrical reliability of the head can hence be improved.

Further, there can be provided a manufacturing method of a liquid jet recording head in which in the above-discussed sealing process for obtaining the reliable sealing condition, the first sealing resin and the second sealing resin undergo simultaneous complete curing, and therefore the sealing process time can be shortened and its productivity efficiency can be enhanced.

Further, there can be provided a manufacturing method of a liquid jet recording head in which no boundary layer (interface) between the first and second sealing resins is formed in the electrode lead portion and the electrical connecting portion to be sealed, and the electrode lead portion and the electrical connecting portion are sealed by the first sealing resin without presence of the interface in the electrode lead portion and the electrical connecting portion. Therefore, reliability of the sealing condition is high, and even when the compatible layer appears in the boundary layer between the first and second sealing resins, there is no problem with the sealing condition of the electrode lead and the electrical contact. Furthermore, the sealing characteristic against ink and the like can be improved, and electrical reliability of the head can be improved.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A method of manufacturing a liquid jet recording head, comprising:

forming a recess portion between a flexible film wiring board and a recording element board;

providing in the recess portion an electrical connecting portion for electrically connecting the flexible film wiring board and the recording element board;

injecting a first resin into the recess portion;

curing the first resin in a membrane form wherein an outer portion of the first resin is cured and an inner portion of the first resin is fluid; and covering an upper portion of the electrical connecting portion and the first resin with a second resin subsequent to said curing the first resin in a membrane form.

2. A manufacturing method of a liquid jet recording head according to claim 1, wherein the thermosetting silicon-denatured epoxy resin is filled in the recess portion so that the electrical connecting portion is buried in the thermosetting silicon-denatured epoxy resin.

3. A manufacturing method of a liquid jet recording head according to claim 1, wherein after the thermosetting epoxy resin is laid, the thermosetting silicon-denatured epoxy resin and the thermosetting epoxy resin are fully cured.

4. A manufacturing method of a liquid jet recording head according to claim 1, wherein the thermosetting epoxy resin is laid subsequent to the membrane curing of the thermosetting silicon-denatured epoxy resin such that no compatible layer occurs at a boundary between the thermosetting silicon-denatured epoxy resin and the thermosetting epoxy resin.

5. A manufacturing method of a liquid jet recording head according to claim 1, wherein in the event that a compatible layer occurs between the thermosetting silicon-denatured epoxy resin and the thermosetting epoxy resin, the thermosetting epoxy resin is laid such that the compatible layer is fully covered with the thermosetting epoxy resin.

6. A manufacturing method of a liquid jet recording head according to claim 1, wherein a plurality of electrode leads provided around an opening portion of the flexible film wiring board are subjected to surface treatment for enhancing wettability.

* * * * *